US011065884B2

(12) United States Patent
Mizuno

(10) Patent No.: US 11,065,884 B2
(45) Date of Patent: Jul. 20, 2021

(54) LIQUID JETTING APPARATUS

(71) Applicant: BROTHER KOGYO KABUSHIKI KAISHA, Nagoya (JP)

(72) Inventor: Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 70 days.

(21) Appl. No.: 16/433,188

(22) Filed: Jun. 6, 2019

(65) Prior Publication Data

US 2020/0079100 A1 Mar. 12, 2020

(30) Foreign Application Priority Data

Sep. 12, 2018 (JP) ..... JP2018-170258

(51) Int. Cl.
*B41J 2/185* (2006.01)
*B41J 2/14* (2006.01)
*B41J 2/175* (2006.01)

(52) U.S. Cl.
CPC ..... *B41J 2/185* (2013.01); *B41J 2/14* (2013.01); *B41J 2/175* (2013.01)

(58) Field of Classification Search
CPC . B41J 2202/12; B41J 2/175; B41J 2/14; B41J 2/18; B41J 2/185
See application file for complete search history.

(56) References Cited

U.S. PATENT DOCUMENTS

2007/0252860 A1* 11/2007 Nitta ..... B41J 2/17596 347/14
2008/0136860 A1* 6/2008 Kyoso ..... B41J 2/175 347/19
2010/0238238 A1* 9/2010 Yamamoto ..... B41J 2/1404 347/85
2011/0228012 A1* 9/2011 Yoshida ..... B41J 2/14274 347/68
2013/0208059 A1* 8/2013 Arimoto ..... B41J 2/14233 347/85
2015/0273847 A1* 10/2015 Mizuno ..... B41J 2/195 347/93
2017/0197420 A1* 7/2017 Okushima ..... B41J 2/14145
2017/0197431 A1 7/2017 Yamada et al.
2018/0022092 A1* 1/2018 Mori ..... B41J 2/18 347/47
2018/0281409 A1* 10/2018 Sugai ..... B41J 2/045
2018/0319162 A1* 11/2018 Kobayashi ..... B41J 2/14072

FOREIGN PATENT DOCUMENTS

JP 11-342634 A 12/1999
JP 2017-124609 A 7/2017

* cited by examiner

*Primary Examiner* — John Zimmermann
(74) *Attorney, Agent, or Firm* — Merchant & Gould P.C.

(57) ABSTRACT

A liquid jetting apparatus includes: liquid jetting heads which are arranged along a predetermined arrangement direction and each of which has a first nozzle to jet a first liquid and a second nozzle to jet a second liquid, a first tank in which the first liquid is stored, a second tank in which the second liquid is stored, first supply channels which connect the first tank and the liquid jetting heads, second supply channels which connect the second tank and the liquid jetting heads, first return channels which connect the liquid jetting heads and the first tank, and second return channels which connect the liquid jetting heads and the second tank. The first tank and the second tank are arranged to deviate from each other in the arrangement direction.

13 Claims, 9 Drawing Sheets

LIQUID JETTING APPARATUS

CROSS REFERENCE TO RELATED APPLICATION

The present application claims priority from Japanese Patent Application No. 2018-170258, filed on Sep. 12, 2018, the disclosure of which is incorporated herein by reference in their entirety.

BACKGROUND

Field of the Invention

The present invention relates to a liquid jetting apparatus configured to jet liquid from nozzles.

Description of the Related Art

As a liquid jetting apparatus which jets liquid from nozzles, there is known an ink jet recording apparatus carrying out recording by jetting ink from nozzles. In such an ink jet recording apparatus, recording element substrates are arranged in one row. The inner channels of the recording element substrates are connected with a common supply channel and a common recovery channel. Then, the ink flows from the common supply channel into the inner channels of the recording element substrates, and then the ink flows out of the inner channels of the recording element substrates into the common recovery channel. The common supply channel and the common recovery channel are connected to a buffer tank. Circulation pumps are provided respectively between the common supply channel and the buffer tank and between the common recovery channel and the buffer tank. By virtue of this, it is possible to circulate the ink between the inner channels of the recording element substrates and the buffer tank.

Further, the ink jet recording apparatus is configured to jet the ink of four colors. The ink of each color is, as described above, circulated between the inner channels of the recording element substrates and the buffer tank.

SUMMARY

In the above ink jet recording apparatus, between the recording element substrates, there is a difference in length with respect to the channels connecting the buffer tank and the inner channels of the recording element substrates. Therefore, between the recording element substrates, there is also a difference in channel resistance with respect to the channels connecting the buffer tank and the inner channels of the recording element substrates. Hence, there is a difference in pressure with respect to the ink in the nozzles between the recording element substrates and, as a result, there is a difference in the likelihood to damage the ink meniscus in the nozzles against pressure variation. In such cases, for the ink channels of the respective colors, between the recording element substrates, if there is a difference in the channel resistances of the channels connecting the buffer tank and the inner channels of the recording element substrates, then such a bias will arise that for a specific recording element substrate, the nozzle meniscus is likely to be damaged for the ink of any color whereas for another recording element substrate, the nozzle meniscus is unlikely to be damaged for the ink of any color.

An object of the present teaching is to provide a liquid jetting apparatus capable of having a uniform unlikelihood to damage the nozzle meniscus among liquid jetting heads where liquid circulates between a liquid tank and the liquid jetting heads.

According to an aspect of the present teaching, there is provided a liquid jetting apparatus including: liquid jetting heads which are arranged along a predetermined arrangement direction and each of which has a first nozzle to jet a first liquid and a second nozzle to jet a second liquid; a first tank in which the first liquid is stored; a second tank in which the second liquid is stored; first supply channels which connect the first tank and the liquid jetting heads to supply the first liquid from the first tank to the liquid jetting heads; second supply channels which connect the second tank and the liquid jetting heads to supply the second liquid from the second tank to the liquid jetting heads; first return channels which connect the liquid jetting heads and the first tank to return the first liquid from the liquid jetting heads to the first tank; an second return channels which connect the liquid jetting heads and the second tank to return the second liquid from the liquid jetting heads to the second tank, wherein the first tank and the second tank are arranged to deviate from each other in the arrangement direction.

DESCRIPTION OF THE EMBODIMENTS

First Embodiment

Hereinbelow, a first embodiment of the present teaching will be explained.

<Schematic Configuration of Printer 1>

Figure 1:
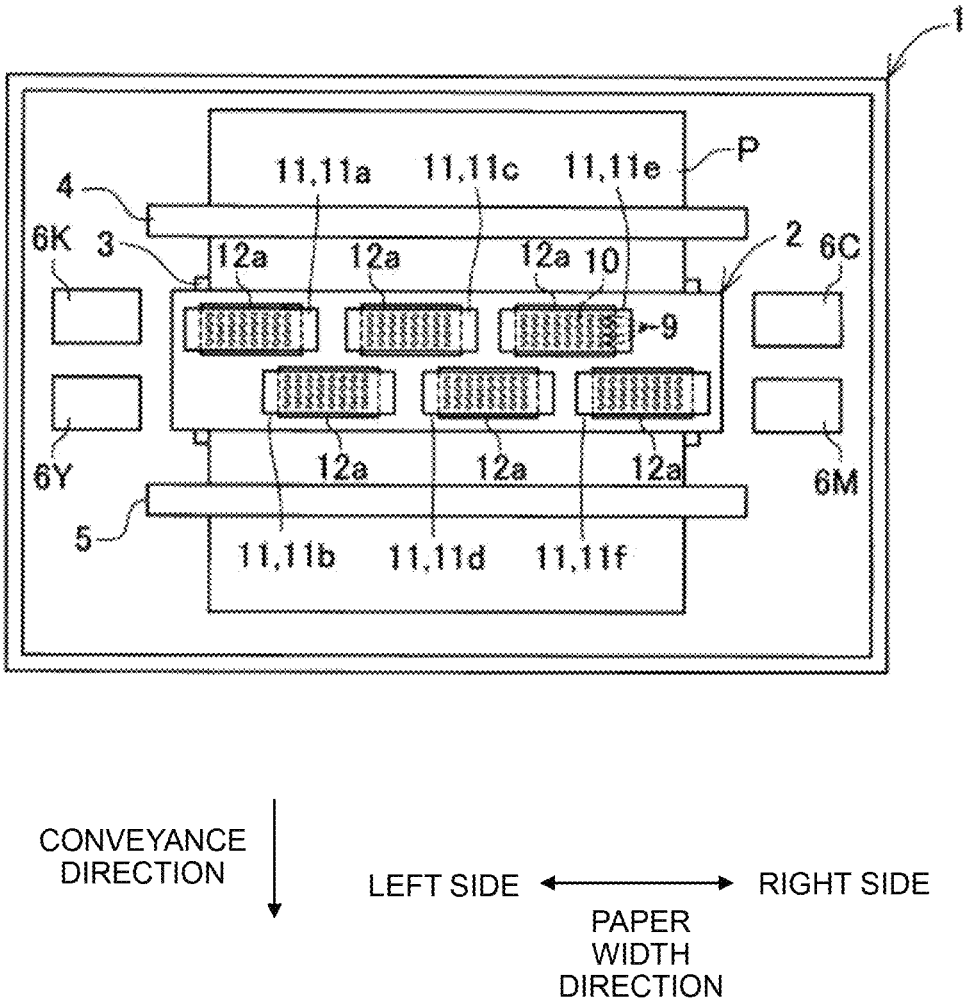
FIG. 1 is a schematic configuration diagram of a printer according to a first embodiment of the present teaching.

As depicted in FIG. 1, a printer 1 according to a first embodiment includes an ink jet head 2, a platen 3, conveyance rollers 4 and 5, four ink tanks 6K, 6Y, 6C, and 6M.

The ink jet head 2 has six head units 11 (11*a* to 11*f*: the "liquid jetting head" of the present teaching), and a holding member 12. Each of the six head units 11 includes ink channels including nozzles 10 formed in its lower surface, drive elements for applying jet energy to an ink in the nozzles 10, etc., so as to jet the ink from the nozzles 10. However, because their configurations are the same as the conventional ones, more detailed explanations are omitted here than the above.

The nozzles 10 of any head unit 11 are arrayed in a paper width direction (a left/right direction in FIG. 1: the "arrangement direction" of the present teaching) to form nozzle rows 9 such that the head unit 11 includes four nozzle rows 9 aligning in a conveyance direction orthogonal to the paper width direction. From the nozzles 10, the inks of black, yellow, magenta, and cyan are respectively jetted in this order from the nozzles forming the nozzle rows 9 at the upstream side in the conveyance direction.

Note that in the first embodiment, the nozzles 10 forming the two nozzle rows 9 at the upstream side in the conveyance direction to jet the black and yellow inks correspond to the "first nozzle" of the present teaching, while the nozzles 10 forming the two nozzle rows 9 at the downstream side in the conveyance direction to jet the cyan and magenta inks correspond to the "second nozzle" of the present teaching. Further, as depicted in FIG. 1, the left side and the right side in the paper width direction are defined for carrying out the explanation.

Further, in the ink jet head 2, among the six head units 11, the three head units 11*a*, 11*c* and 11*e*, and the three head units 11*b*, 11*d*, and 11*f* are arrayed respectively in one row along the paper width direction. Further, the three head units 11*b*, 11*d* and 11*f* are arranged at the downstream side of the three head units 11*a*, 11*c* and 11*e* in the conveyance direction. Further, the head units 11*b*, 11*d* and 11*f* are arranged to deviate to the right side from the head units 11*a*, 11*c* and 11*e* in the paper width direction. By virtue of this, the nozzles 10 of the six head units 11 are arranged across the entire length of recording paper P in the paper width direction. That is, the ink jet head 2 is a so-called line head.

The holding member 12 is a rectangular plate-like member with the paper width direction as its longitudinal direction, and the six head units 11 are fixed on the holding member 12. In the holding member 12, six through holes 12*a* are formed to correspond to the six head units 11. The nozzles 10 of each head unit 11 are exposed at the lower side (at the side of the recording paper P) from the corresponding through hole 12*a*.

The platen 3 is arranged below the ink jet head 2 to face the nozzles 10 of the six head units 11. The platen 3 supports the recording paper P from below. The conveyance roller 4 is arranged at the upstream side of the ink jet head 2 and the platen 3 in the conveyance direction. The conveyance roller 5 is arranged at the downstream side of the ink jet head 2 and the platen 3 in the conveyance direction. The conveyance rollers 4 and 5 convey the recording paper P in the conveyance direction.

The ink tanks 6K and 6Y (the "first tank" of the present teaching) are arranged at the left side of the ink jet head 2 in the paper width direction. The ink tanks 6C and 6M (the "second tank" of the present teaching) are arranged at the right side of the ink jet head 2 in the paper width direction. That is, the ink tanks 6K and 6Y are arranged to deviate from the ink tanks 6C and 6M in the paper width direction. The ink tanks 6K, 6Y, 6C and 6M retain the inks of black, yellow, cyan, and magenta, respectively.

Each of the ink tanks 6 is connected with the six head units 11, and the inks circulate respectively between the ink tanks 6K, 6Y, 6C and 6M and the six head units 11. Explanation will be made later on about the channel configuration and the like for circulating the inks between the ink tanks 6K, 6Y, 6C and 6M and the six head units 11. Further, the ink tanks 6K, 6Y, 6C and 6M are connected respectively with unshown ink cartridges through unshown tubes and the like to supply the inks from the ink cartridges to the ink tanks 6K, 6Y, 6C and 6M.

Then, in the printer 1, the conveyance rollers 4 and 5 convey the recording paper P in the conveyance direction while the inks are jetted from the nozzles 10 of the six head units 11, and thereby printing is carried out on the recording paper P.

<Connection Between the Ink Tanks 6K, 6Y, 6C and 6M and the Head Units 11>

Next, an explanation will be made on the connection between the ink tanks 6K, 6Y, 6C and 6M and the six head units 11. As depicted in FIGS. 2 to 5, on the upper surface of each head unit 11, there are provided four supply ports 21K, 21Y, 21C and 21M for supplying the inks to the head unit 11, and there are provided four discharge ports 22K, 22Y, 22C and 22M for discharging the inks from the head unit 11.

<Supply Channels 23K and 23Y>

Figure 2:
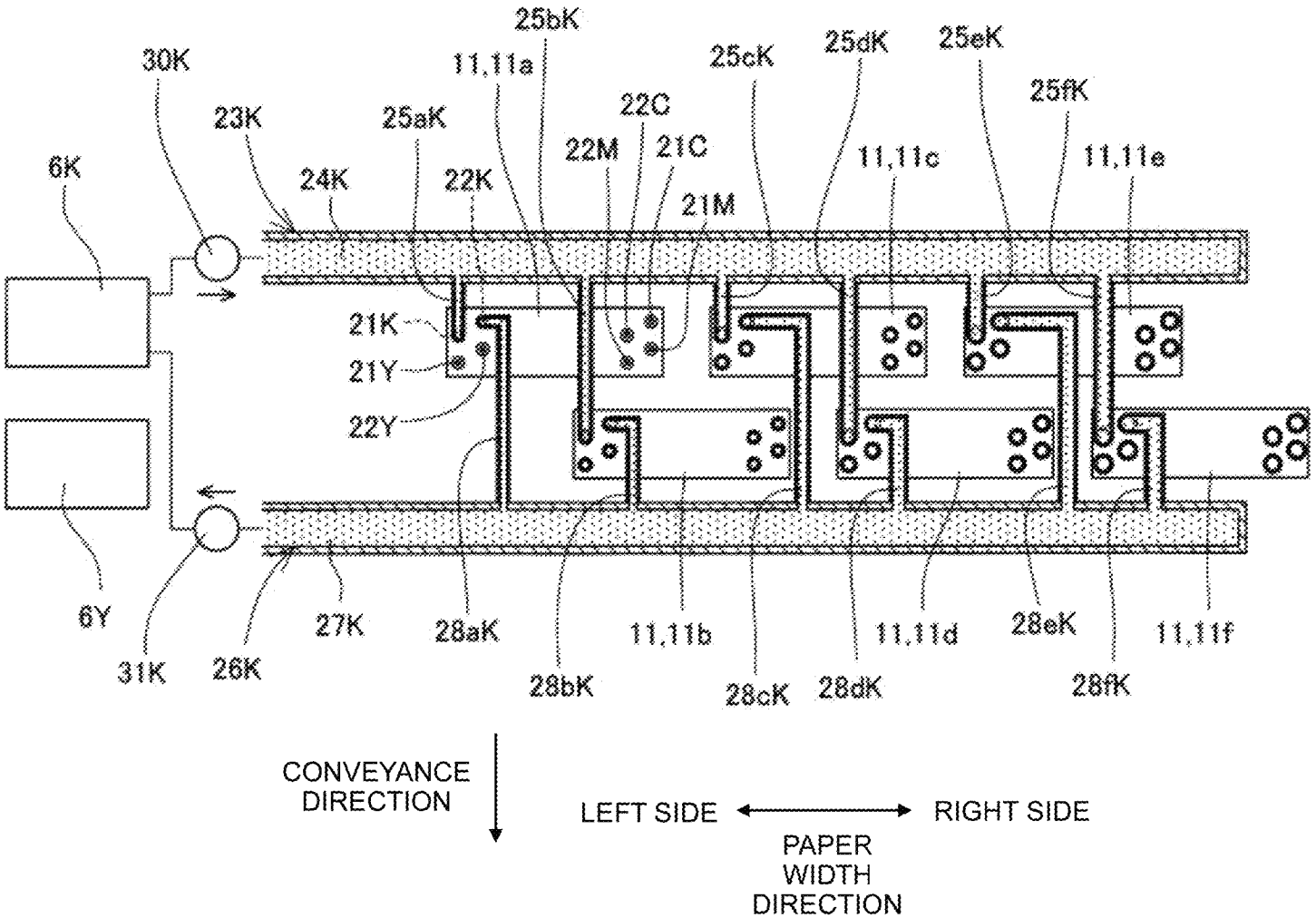
FIG. 2 depicts a configuration of a channel connecting a black ink tank and head units according to the first embodiment.
Figure 3:
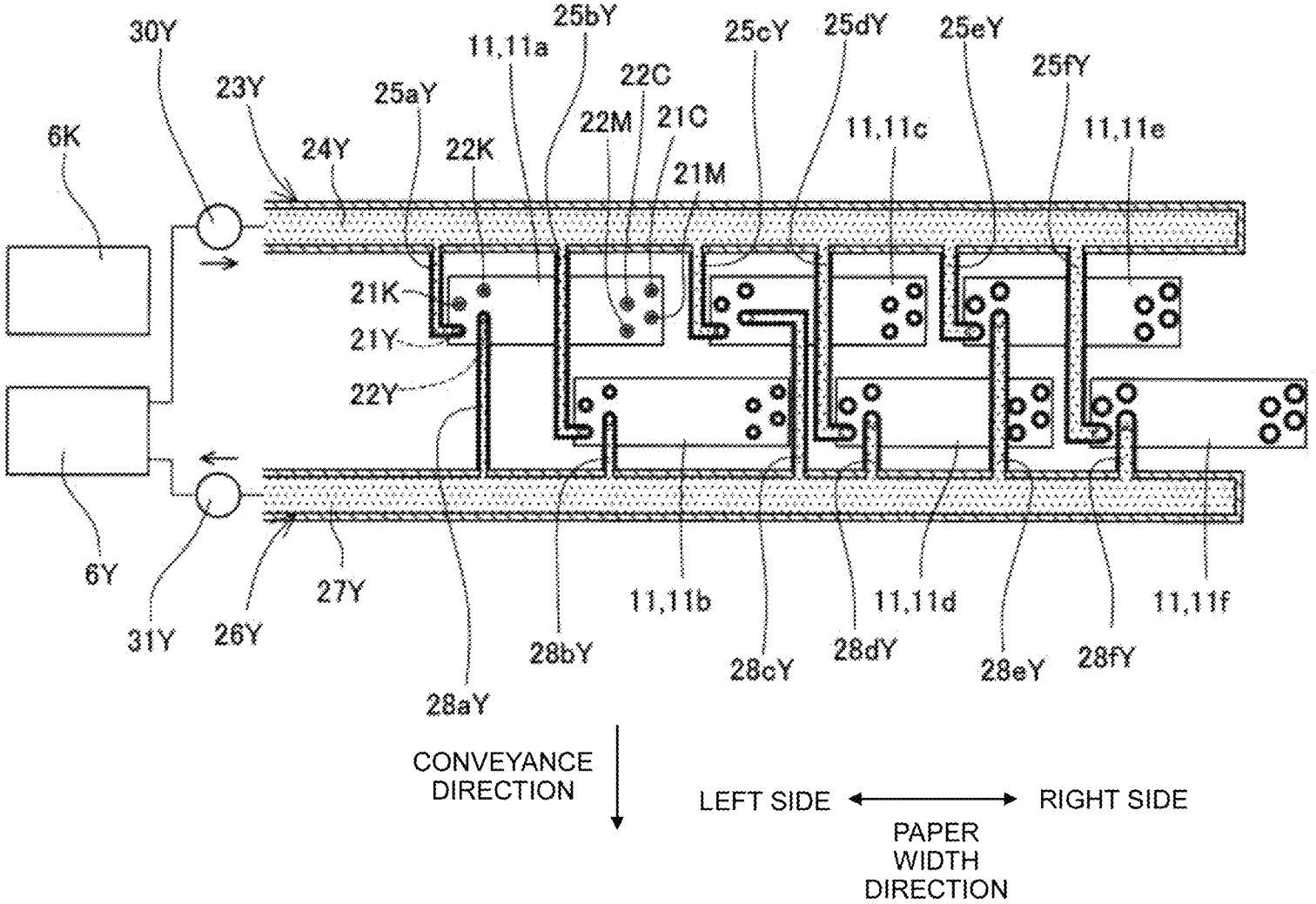
FIG. 3 depicts a configuration of a channel connecting a yellow ink tank and the head units according to the first embodiment.

As depicted in FIGS. 2 and 3, the ink tanks 6K and 6Y are connected with the six supply ports 21K of the six head units 11, respectively, via supply channels 23K and 23Y. The supply channels 23K and 23Y have common supply channels 24K and 24Y, individual supply channels 25*a*K to 25*f*K and 25*a*Y to 25*f*Y, respectively.

The common supply channels 24K and 24Y extend in the paper width direction across the six head units 11. The common supply channels 24K and 24Y are formed from, for example, channel members made of metallic material, synthetic resin material, or the like. Here in FIGS. 2 and 3, in order for a better view of the drawings, the common supply channels 24K and 24Y are arranged seemingly in positions deviating from the six head units 11 at the upstream side in the conveyance direction, whereas the common supply channels 24K and 24Y are arranged actually, for example, right above the six head units 11. Much the same is true on aftermentioned common supply channels 24C and 24M, and aftermentioned common supply channels 102K, 102Y, 102C and 102M according to a second embodiment.

Further, the left ends of the common supply channels 24K and 24Y are connected respectively with the ink tanks 6K and 6Y via supply side pumps 30K and 30Y. The supply side pumps 30K and 30Y send the inks from the ink tanks 6K and 6Y toward the common supply channels 24K and 24Y.

The individual supply channels 25*a*K to 25*f*K and 25*a*Y to 25*f*Y correspond respectively to the six head units 11*a* to 11*f*, and the common supply channels 24K and 24Y are connected respectively with the supply ports 21K and 21Y of the six head units 11*a* to 11*f*. The individual supply channels 25*a*K to 25*f*K and 25*a*Y to 25*f*Y are formed from, for example, tubes or the like.

Note that in FIGS. 2 and 3, as described above, the common supply channels 24K and 24Y are depicted as if deviating from the six head units 11 at the upstream side in the conveyance direction; therefore, to some extent, there is a difference in length with respect to the individual supply channels 25*a*K to 25*f*K and 25*a*Y to 25*f*Y. However, in reality, the individual supply channels 25*a*K to 25*f*K have almost the same length as the individual supply channels 25*a*Y to 25*f*Y, respectively. Much the same is true on the aftermentioned length of the individual supply channels 25*a*C to 25*f*C, and length of the individual supply channels 25*a*M to 25*f*M, as well as the aftermentioned length of individual supply channels 103*a*K to 103*f*K according to the second embodiment, length of individual supply channels

103*a*Y to 103*f*Y, length of individual supply channels 103*a*C to 103*f*C, and length of individual supply channels 103*a*M to 103*f*M.

<Return Channels 26K and 26Y>

As depicted in FIGS. 2 and 3, the ink tanks 6K and 6Y are connected respectively with the six discharge ports 22K of the six head units 11 via return channels 26K and 26Y. The return channels 26K and 26Y have common return channels 27K and 27Y, and individual return channels 28*a*K to 28*f*K and 28*a*Y to 28*f*Y, respectively.

The common return channels 27K and 27Y extend respectively in the paper width direction across the six head units 11. The common return channels 27K and 27Y are formed from, for example, channel members made of metallic material, synthetic resin material, or the like. Here in FIGS. 2 and 3, in order for a better view of the drawings, the common return channels 27K and 27Y are arranged seemingly in positions deviating from the six head units 11 at the downstream side in the conveyance direction, whereas the common return channels 27K and 27Y are arranged actually, for example, right above the six head units 11. Much the same is true on aftermentioned common return channels 27C and 27M, and aftermentioned common return channels 105K, 105Y, 105C and 105M according to the second embodiment.

Further, the left ends of the common return channels 27K and 27Y are connected respectively with the ink tanks 6K and 6Y via discharge side pumps 31K and 31Y. The discharge side pumps 31K and 31Y send the inks from the common return channels 27K and 27Y toward the ink tanks 6K and 6Y, respectively.

The individual return channels 28*a*K to 28*f*K and 28*a*Y to 28*f*Y correspond respectively to the six head units 11*a* to 11*f*, and the common return channels 27K and 27Y are connected respectively with the discharge ports 22K and 22Y of the six head units 11*a* to 11*f*. The individual return channels 28*a*K to 28*f*K and 28*a*Y to 28*f*Y are formed from, for example, tubes or the like.

Note that in FIGS. 2 and 3, as described above, the common return channels 27K and 27Y are depicted as if deviating from the six head units 11 at the downstream side in the conveyance direction; therefore, to some extent, there is a difference in length with respect to the individual return channels 28*a*K to 28*f*K and 28*a*Y to 28*f*Y. However, in reality, the individual return channels 28*a*K to 28*f*K have almost the same length as the individual return channels 28*a*Y to 28*f*Y, respectively. Much the same is true on the aftermentioned length of the individual return channels 28*a*C to 28*f*C, and length of the individual return channels 28*a*M to 28*f*M, as well as the aftermentioned length of individual return channels 106*a*K to 106*f*K according to the second embodiment, length of individual return channels 106*a*Y to 106*f*Y, length of individual return channels 106*a*C to 106*f*C, and length of individual return channels 106*a*M to 106*f*M. Note that the individual supply channels where the ink of the same color flows may be the same or different in length as or from the individual return channels.

<Supply Channels 23C and 23M>

Figure 4:
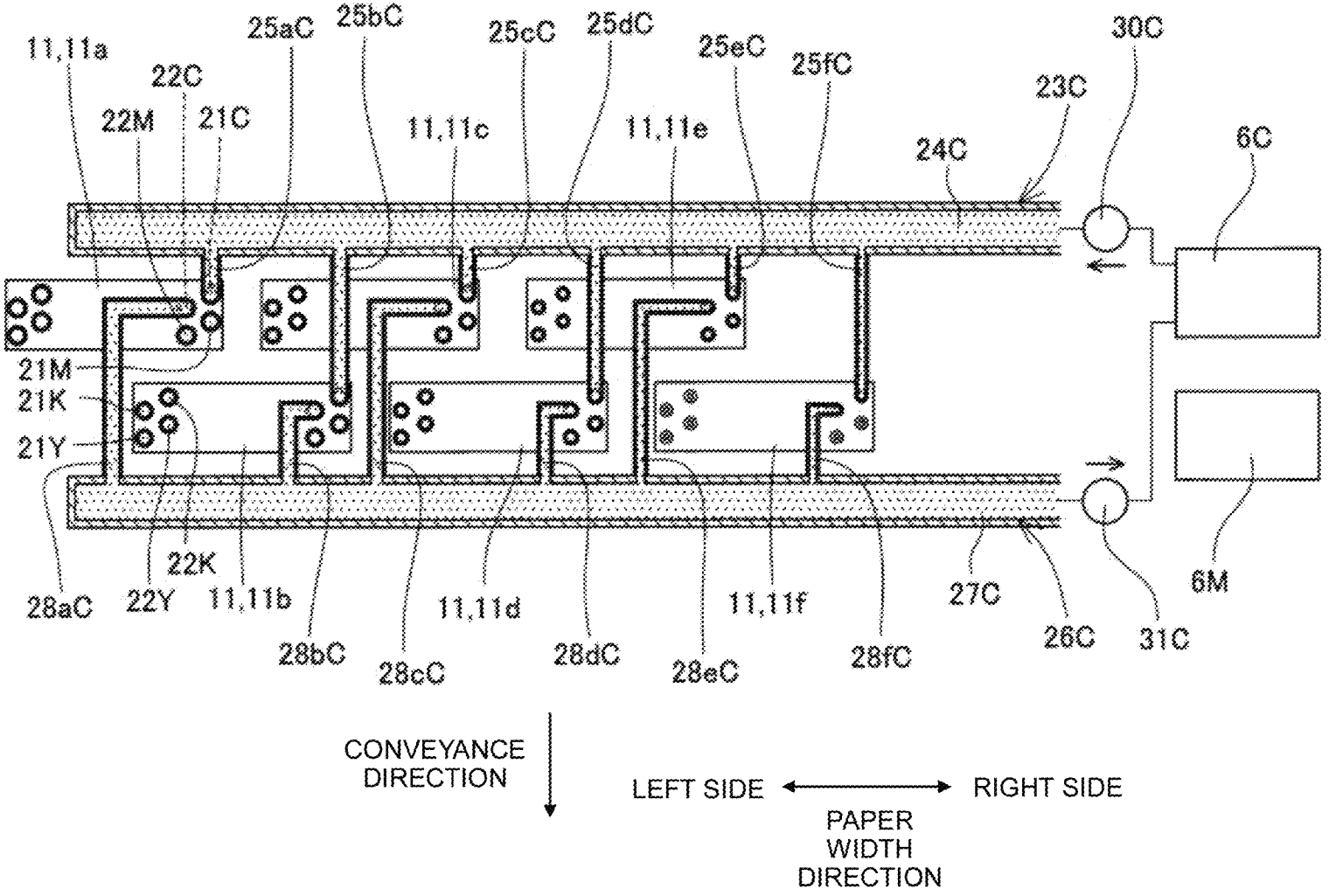
FIG. 4 depicts a configuration of a channel connecting a cyan ink tank and the head units according to the first embodiment.
Figure 5:
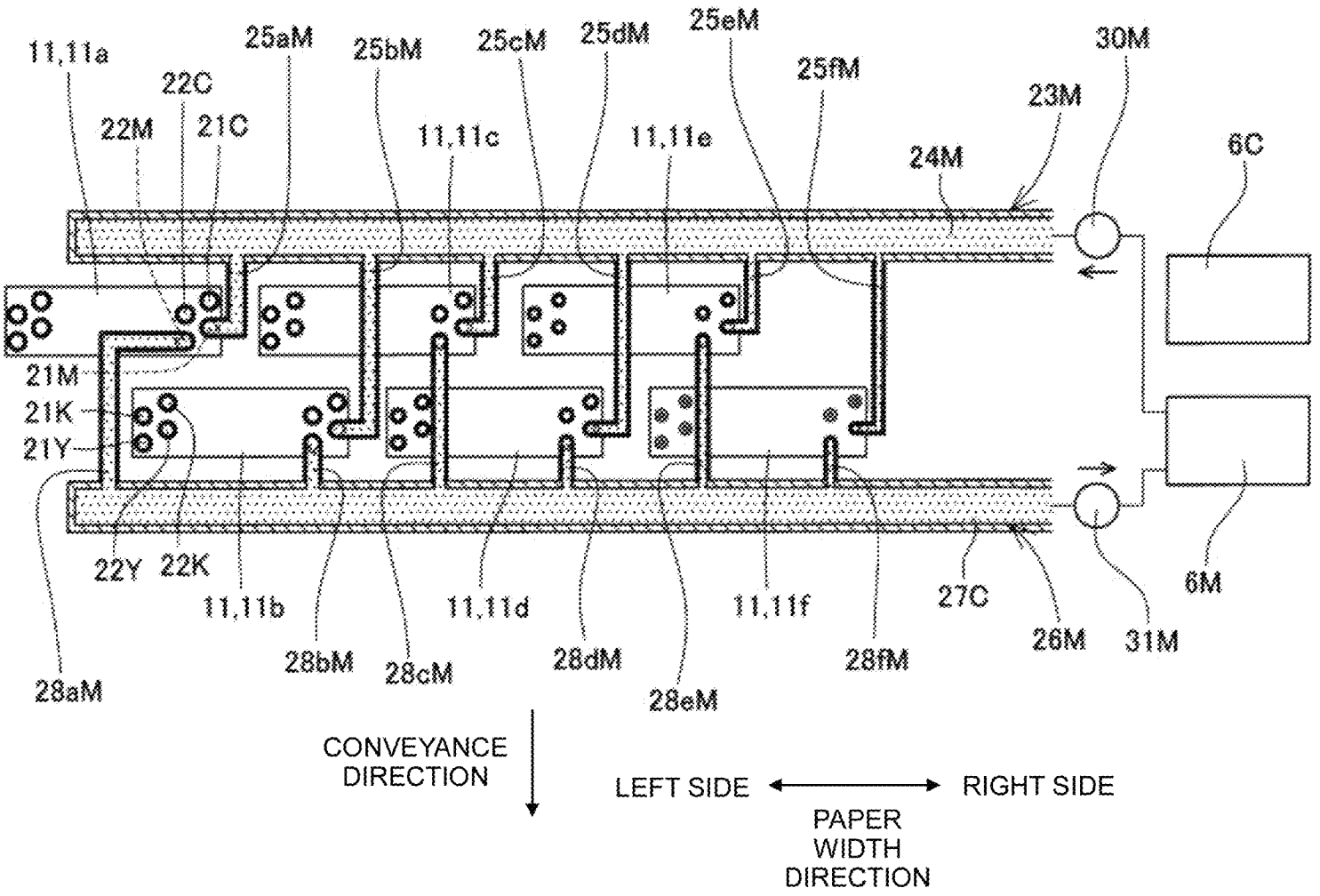
FIG. 5 depicts a configuration of a channel connecting a magenta ink tank and the head units according to the first embodiment.

As depicted in FIGS. 4 and 5, the ink tanks 6C and 6M are connected with the six supply ports 21C and 21M of the six head units 11, respectively, via supply channels 23C and 23M. The supply channels 23C and 23M have common supply channels 24C and 24M, individual supply channels 25*a*C to 25*f*C and 25*a*M to 25*f*M, respectively.

The common supply channels 24C and 24M extend in the paper width direction across the six head units 11. The common supply channels 24C and 24M are formed from, for example, channel members made of metallic material, synthetic resin material, or the like. Further, the right ends of the common supply channels 24C and 24M are connected respectively with the ink tanks 6C and 6M via supply side pumps 30C and 30M. The supply side pumps 30C and 30M send the inks from the ink tanks 6C and 6M toward the common supply channels 24C and 24M.

The individual supply channels 25*a*C to 25*f*C and 25*a*M to 25*f*M correspond respectively to the six head units 11*a* to 11*f*, and the common supply channels 24C and 24M are connected respectively with the supply ports 21C and 21M of the six head units 11*a* to 11*f*. The individual supply channels 25*a*C to 25*f*C and 25*a*M to 25*f*M are formed from, for example, tubes or the like.

<Return Channels 26C and 26M>

As depicted in FIGS. 4 and 5, the ink tanks 6C and 6M are connected respectively with the six discharge ports 22C of the six head units 11 via return channels 26C and 26M. The return channels 26C and 26M have common return channels 27C and 27M, and individual return channels 28*a*C to 28*f*C and 28*a*M to 28*f*M, respectively.

The common return channels 27C and 27M extend respectively in the paper width direction across the six head units 11. The common return channels 27C and 27M are formed from, for example, channel members made of metallic material, synthetic resin material, or the like. Further, the right ends of the common return channels 27C and 27M are connected respectively with the ink tanks 6C and 6M via discharge side pumps 31C and 31M. The discharge side pumps 31C and 31M send the inks from the common return channels 27C and 27M toward the ink tanks 6C and 6M, respectively.

The individual return channels 28*a*C to 28*f*C and 28*a*M to 28*f*M correspond respectively to the six head units 11*a* to 11*f*, and the common return channels 27C and 27M are connected respectively with the discharge ports 22C of the six head units 11*a* to 11*f*. The individual return channels 28*a*C to 28*f*C and 28*a*M to 28*f*M are formed from, for example, tubes or the like.

<Magnitude Relation of Channel Resistance Between Parts of Supply Channels>

In the first embodiment, the cross sectional areas S1*a*K, S1*b*K, S1*c*K, S1*d*K, S1*e*K, and S1*f*K, of the cross sections of the individual supply channels 25*a*K to 25*f*K, being orthogonal to their length direction, have such a magnitude relation as S1*a*K<S1*b*K<S1*c*K<S1*d*K<S1*e*K<S1*f*K.

That is, among the individual supply channels 25*a*K to 25*f*K, those being further rightward in the paper width direction, connected to the parts farther away from the parts of the common supply channel 24K connected with the ink tank 6K, have larger areas of the abovementioned cross sections (smaller in channel resistance per unit length). Further, as described earlier on, the individual supply channels 25*a*K to 25*f*K have almost the same length. Therefore, among the individual supply channels 25*a*K to 25*f*K, those connected with the head units 11 positioned further rightward have smaller channel resistances.

On the other hand, in the common supply channel 24K, the parts connecting the ink tank 6K and the individual supply channels 25*a*K to 25*f*K have larger lengths corresponding to the head units 11 positioned further rightward in the paper width direction. That is, in the common supply channel 24K, the parts connecting the ink tank 6K and those of the individual supply channels 25*a*K to 25*f*K positioned further rightward in the paper width direction have larger channel resistances.

In view of these facts, among the parts of the supply channel 23K connecting the ink tank 6K and the respective head units 11, those connecting the ink tank 6K and the head units 11 positioned further rightward in the paper width direction have larger lengths, and smaller channel resistances per unit area. Then, in the supply channel 23K, the difference in channel resistance between the above parts of the common supply channel 24K offsets the difference in the channel resistances of the individual supply channels 25*a*K to 25*f*K, such that the difference in channel resistance between the parts connecting the ink tank 6K and the respective head units 11 stays within a predetermined range (within the range of ±5%, for example). Further, in the same manner as described above, in the supply channel 23Y, the difference in channel resistance between the parts connecting the ink tank 6Y and the respective head units 11 stays within a predetermined range (within the range of ±5%, for example).

Here, the parts of the supply channel 23K connecting the ink tank 6K and the head units 11 are a combination of one individual supply channel of the individual supply channels 25*a*K to 25*f*K, and such a part of the common supply channel 24K as from the part connected with the ink tank 6K to the part connected with that one individual supply channel. Much the same is true on the supply channels 23Y, 23C, and 23M. Note that in the first embodiment, between the supply channels 23K and 23Y, the parts connecting the ink tanks 6K and 6Y and the respective head units 11 correspond respectively to the "first supply channel" of the present teaching.

Further, the cross sectional areas S1*a*C, S1*b*C, S1*c*C, S1*d*C, S1*e*C, and S1*f*C, of the cross sections of the individual supply channels 25*a*C to 25*f*C, being orthogonal to their length direction, have such a magnitude relation as S1*a*C>S1*b*C>S1*c*C>S1*d*C>S1*e*C>S1*f*C.

That is, among the individual supply channels 25*a*C to 25*f*C, those being further leftward in the paper width direction, connected to the parts farther away from the parts of the common supply channel 24C connected with the ink tank 6C, have larger areas of the abovementioned cross sections (smaller in channel resistance per unit length). Further, as described earlier on, the individual supply channels 25*a*C to 25*f*C have almost the same length. Therefore, among the individual supply channels 25*a*C to 25*f*C, those connected with the head units 11 positioned further leftward have smaller channel resistances.

On the other hand, in the common supply channel 24C, the parts connecting the ink tank 6C and the individual supply channels 25*a*C to 25*f*C have larger lengths corresponding to the head units 11 positioned further leftward in the paper width direction. That is, in the common supply channel 24C, the parts connecting the ink tank 6C and those of the individual supply channels 25*a*C to 25*f*C positioned further leftward in the paper width direction have larger channel resistances.

In view of these facts, among the parts of the supply channel 23C connecting the ink tank 6C and the respective head units 11, those connecting the ink tank 6C and the head units 11 positioned further leftward in the paper width direction have larger lengths, and smaller channel resistances per unit area. Then, in the supply channel 23C, the difference in channel resistance between the above parts of the common supply channel 24C offsets the difference in the channel resistances of the individual supply channels 25*a*C to 25*f*C, such that the difference in channel resistance between the parts connecting the ink tank 6C and 6M and the respective head units 11 stays within a predetermined range (within the range of ±5%, for example). Further, in the same manner as described above, in the supply channel 23M, the difference in channel resistance between the parts connecting the ink tank 6M and the respective head units 11 stays within a predetermined range (within the range of ±5%, for example). Note that in the first embodiment, between the supply channels 23C and 23M, the parts connecting the ink tanks 6C and 6M and the respective head units 11 correspond respectively to the "second supply channel" of the present teaching.

<Magnitude Relation of Channel Resistance Between Parts of Return Channels>

Further, the cross sectional areas S2*a*K, S2*b*K, S2*c*K, S2*d*K, S2*e*K, and S2*f*K, of the cross sections of the individual return channels 28*a*K to 28*f*K, being orthogonal to their length direction, have such a magnitude relation as S2*a*K<S2*b*K<S2*c*K<S2*d*K<S2*e*K<S2*f*K.

That is, among the individual return channels 28*a*K to 28*f*K, those being further rightward in the paper width direction, connected to the parts farther away from the parts of the common return channel 27K connected with the ink tank 6K, have larger areas of the abovementioned cross sections (smaller in channel resistance per unit length). Further, as described earlier on, the individual return channels 28*a*K to 28*f*K have almost the same length. Therefore, among the individual return channels 28*a*K to 28*f*K, those connected with the head units 11 positioned further rightward have smaller channel resistances.

On the other hand, in the common return channel 27K, the parts connecting the ink tank 6K and the individual return channels 28*a*K to 28*f*K have larger lengths corresponding to the head units 11 positioned further rightward in the paper width direction. That is, in the common supply channel 27K, the parts connecting the ink tank 6K and those of the individual return channels 28*a*K to 28*f*K positioned further rightward in the paper width direction have larger channel resistances.

In view of these facts, among the parts of the return channel 26K connecting the ink tank 6K and the respective head units 11, those connecting the ink tank 6K and the head units 11 positioned further rightward in the paper width direction have larger lengths, and smaller channel resistances per unit area. Then, in the return channel 26K, the difference in channel resistance between the above parts of the common return channel 26K offsets the difference in the channel resistances of the individual return channels 28*a*K to 28*f*K, such that the difference in channel resistance between the parts connecting the ink tank 6K and the respective head units 11 stays within a predetermined range (within the range of ±5%, for example). Further, in the same manner as described above, in the return channel 26Y, the difference in channel resistance between the parts connecting the ink tank 6Y and the respective head units 11 stays within a predetermined range (within the range of ±5%, for example).

Here, the parts of the return channel 26K connecting the ink tank 6K and the head units 11 are a combination of one individual return channel of the individual return channels 28*a*K to 28*f*K, and such a part of the common return channel 27K as from the part connected with the ink tank 6K to the part connected with that one individual return channel. Much the same is true on the return channels 26Y, 26C, and 26M. Note that in the first embodiment, between the return channels 26K and 26Y, the parts connecting the ink tanks 6K and 6Y and the respective head units 11 correspond respectively to the "first return channel" of the present teaching.

Further, the cross sectional areas S2*a*C, S2*b*C, S2*c*C, S2*d*C, S2*e*C, and S2*f*C, of the cross sections of the individual return channels 28*a*C to 28*f*C, being orthogonal to their length direction, have such a magnitude relation as S2*a*C>S2*b*C>S2*c*C>S2*d*C>S2*e*C>S2*f*C.

That is, among the individual return channels 28*a*C to 28*f*C, those being further leftward in the paper width direction, connected to the parts farther away from the parts of the common return channel 27C connected with the ink tank 6C, have larger areas of the abovementioned cross sections (smaller in channel resistance per unit length). Further, as described earlier on, the individual return channels 28*a*C to 28*f*C have almost the same length. Therefore, among the individual return channels 28*a*C to 28*f*C, those connected with the head units 11 positioned further leftward have smaller channel resistances.

On the other hand, in the common return channel 27C, the parts connecting the ink tank 6C and the individual return channels 28*a*C to 28*f*C have larger lengths corresponding to the head units 11 positioned further leftward in the paper width direction. That is, in the common return channel 27C, the parts connecting the ink tank 6C and those of the individual return channels 28*a*C to 28*f*C positioned further leftward in the paper width direction have larger channel resistances.

In view of these facts, among the parts of the return channel 26C connecting the ink tank 6C and the respective head units 11, those connecting the ink tank 6C and the head units 11 positioned further leftward in the paper width direction have larger lengths, and smaller channel resistances per unit area. Then, in the return channel 26C, the difference in channel resistance between the above parts of the common return channel 27C offsets the difference in the channel resistances of the individual return channels 28*a*C to 28*f*C, such that the difference in channel resistance between the parts connecting the ink tank 6C and 6M and the respective head units 11 stays within a predetermined range (within the range of ±5%, for example). Note that in the first embodiment, between the return channels 26C and 26M, the parts connecting the ink tanks 6C and 6M and the respective head units 11 correspond respectively to the "second return channel" of the present teaching.

<Magnitude Relation of Channel Resistance Between Supply Channels>

Further, in the first embodiment, the cross sectional area S1*a*K of the individual supply channel 25*a*K, where the black ink flows, is larger than the cross sectional areas S1*a*Y, S1*a*C and S1*a*M of the individual supply channels 25*a*Y, 25*a*C and 25*a*M where the color inks flow. Further, the cross sectional areas S1*a*Y, S1*a*C and S1*a*M are almost the same.

Much the same is true as described above on the magnitude relations between the cross sectional areas S1*b*K, S1*b*Y, S1*b*C and S1*b*M, between the cross sectional areas S1*c*K, S1*c*Y, S1*c*C and S1*c*M, between the cross sectional areas S1*d*K, S1*d*Y, S1*d*C and S1*d*M, between the cross sectional areas S1*e*K, S1*e*Y, S1*e*C and S1*e*M, and between the cross sectional areas S1*f*K, S1*f*Y, S1*f*C and S1*f*M.

Further, in the first embodiment, the cross sectional area R1K of the common supply channel 24K, where the black ink flows, is larger than the cross sectional areas R1*y*, R1*c* and R1*m* of the common supply channels 24Y, 24C and 24M where the color inks flow. Further, the cross sectional areas R1*y*, R1*c* and R1*m* are almost the same.

In view of these facts, the parts of the supply channel 23K connecting the ink tank 6K and the respective head units 11 have smaller channel resistances than the parts of the supply channels 23Y, 23C and 23M connecting the respective head units 11 and the ink tanks 6Y, 6C and 6M.

<Magnitude Relation of Channel Resistance Between Return Channels>

Further, in the first embodiment, the cross sectional area S2*a*K of the individual return channel 28*a*K, where the black ink flows, is larger than the cross sectional areas S2*a*Y, S2*a*C and S2*a*M of the individual return channels 28*a*Y, 28*a*C and 28*a*M where the color inks flow. Further, the cross sectional areas S2*a*Y, S2*a*C and S2*a*M are almost the same.

Much the same is true as described above on the magnitude relations between the cross sectional areas S2*b*K, S2*b*Y, S2*b*C and S2*b*M, between the cross sectional areas S2*c*K, S2*c*Y, S2*c*C and S2*c*M, between the cross sectional areas S2*d*K, S2*d*Y, S2*d*C and S2*d*M, between the cross sectional areas S2*e*K, S2*e*Y, S2*e*C and S2*e*M, and between the cross sectional areas S2*f*K, S2*f*Y, S2*f*C and S2*f*M.

Further, the cross sectional area R2K of the common return channel 27K, where the black ink flows, is larger than the cross sectional areas R2*y*, R2*c* and R2*m* of the common return channels 27Y, 27C and 27M where the color inks flow. Further, the cross sectional areas R2*y*, R2*c* and R2*m* of the common return channels 27Y, 27C and 27M are almost the same.

In view of these facts, the parts of the return channel 26K connecting the ink tank 6K and the respective head units 11 have smaller channel resistances than the parts of the return channels 26Y, 26C and 26M connecting the respective head units 11 and the ink tanks 6Y, 6C and 6M.

<Magnitude Relation of Channel Resistances Between the Supply Channels and Return Channels, and the Head Units 11>

Further, in the first embodiment, the parts of the supply channels 23K, 23Y, 23C and 23M connecting the ink tanks 6K, 6Y, 6C and 6M and the head units 11 have such sufficiently small channel resistances as, for example, 1/100 or less than 1/100 of those of the ink channels inside the head units 11 including the nozzles 10.

Further, the parts of the return channels 26K, 26Y, 26C and 26M connecting the ink tanks 6K, 6Y, 6C and 6M and the head units 11 have such sufficiently small channel resistances as, for example, 1/100 or less than 1/100 of those of the ink channels inside the head units 11 including the nozzles 10.

[Effects]

In the first embodiment explained above, as described earlier on, in the supply channel 23Y, the difference in channel resistance between the parts connecting the ink tank 6Y and the respective head units 11 stays within the predetermined range. However, because there is a difference in distance between the ink tank 6K and each head unit 11, the channel resistances thereof differ to some extent. Much the same is true on the relation of the channel resistances between such parts connecting the ink tanks 6Y, 6C and 6M and the respective head units 11 as in the supply channels 23Y, 23C, and 23M.

Therefore, differently from the first embodiment, if the ink tanks 6K, 6Y, 6C and 6M are all arranged only at one side of the ink jet head 2 in the paper width direction, then a bias will arise as follows: in the head units 11 at the side where the ink tanks 6K, 6Y, 6C and 6M are arranged, the distances from the ink tanks 6K, 6Y, 6C and 6M all become small, while in the head units 11 at the other side than that where the ink tanks 6K, 6Y, 6C and 6M are arranged, the distances from the ink tanks 6K, 6Y, 6C and 6M all become large.

As a result, another bias will arise: such parts of the supply channels 23K, 23Y, 23C and 23M as connecting the ink tanks 6K, 6Y, 6C and 6M and any of the head units 11 all become large or all become small. In the same manner, still another bias will arise: such parts of the return channels 26K, 26Y, 26C and 26M as connecting the ink tanks 6K, 6Y, 6C and 6M and any of the head units 11 all become large or all become small.

Here, when the inks are circulated between the ink tanks 6K, 6Y, 6C and 6M and the head units 11, the ink pressure decreases with distance from the supply side pumps 30K, 30Y, 30C and 30M to the discharge side pumps 31K, 31Y, 31C and 31M. On this occasion, if there is a change in the channel resistances of the supply channels 23K, 23Y, 23C and 23M and the return channels 26K, 26Y, 26C and 26M, then the ink pressure in the nozzles 10 will change, such that the ink meniscus in the nozzles 10 will change in the tolerance against the pressure variation. In particular, the higher the ink pressure in the nozzles 10, the larger the meniscus tolerance against the pressure decrease, but the smaller the meniscus tolerance against the pressure increase. On the other hand, the lower the ink pressure in the nozzles 10, the larger the meniscus tolerance against the pressure increase, but the smaller the meniscus tolerance against the pressure decrease.

Therefore, if there is such a bias as described earlier on with respect to the channel resistances of such parts of the supply channels 23K, 23Y, 23C and 23M and the return channels 26K, 26Y, 26C and 26M as connecting the ink tanks 6K, 6Y, 6C and 6M and the head units 11, then in a specific head unit 11, there is a higher likelihood to damage the ink meniscus in the nozzles 10 jetting the inks of all the colors.

To address this problem, in the first embodiment, the ink jet head 2 has the six head units 11 aligning in the paper width direction while the ink tanks 6K and 6Y are arranged at the left side of the ink jet head 2 in the paper width direction and the ink tanks 6C and 6M are arranged at the right side of the ink jet head 2 in the paper width direction.

By virtue of this, the head units 11 having a smaller distance from the ink tanks 6K and 6Y have a larger distance from the ink tanks 6C and 6M whereas the head units 11 having a larger distance from the ink tanks 6K and 6Y have a smaller distance from the ink tanks 6C and 6M.

Therefore, in each of the head units 11, if there are large channel resistances in the parts of the supply channels 23K and 23Y connecting the ink tanks 6K and 6Y and the head units 11, then there are small channel resistances in the parts of the supply channels 23C and 23M connecting the ink tanks 6C and 6M and the head units 11. Further, if there are small channel resistances in the parts of the supply channels 23K and 23Y connecting the ink tanks 6K and 6Y and the head units 11, then there are large channel resistances in the parts of the supply channels 23C and 23M connecting the ink tanks 6C and 6M and the head units 11.

Further, in each of the head units 11, if there are large channel resistances in the parts of the return channels 26K and 26Y connecting the ink tanks 6K and 6Y and the head units 11, then there are small channel resistances in the parts of the return channels 26C and 26M connecting the ink tanks 6C and 6M and the head units 11. Further, if there are small channel resistances in the parts of the return channels 26K and 26Y connecting the ink tanks 6K and 6Y and the head units 11, then there are large channel resistances in the parts of the return channels 26C and 26M connecting the ink tanks 6C and 6M and the head units 11.

Therefore, there is no bias that the channel resistances all become large or all become small in the parts of the supply channels 23K, 23Y, 23C and 23M connected to a specific head unit 11. Further, there is no bias that the channel resistances all become large or all become small in the parts of the return channels 26K, 26Y, 26C and 26M connected to a specific head unit 11.

By virtue of this, in the head units 11 being more likely to damage the ink meniscus in the nozzles 10 jetting the black and yellow inks, there is a less likelihood to damage the ink meniscus in the nozzles 10 jetting the cyan and magenta inks. Further, in the head units 11 being more likely to damage the ink meniscus in the nozzles 10 jetting the cyan and magenta inks, there is a less likelihood to damage the ink meniscus in the nozzles 10 jetting the black and yellow inks. As a result, between the six head units 11, it is possible to bring about no bias in the likelihood to damage the ink meniscus in the nozzles 10.

Further, in the first embodiment, the common supply channels 24K, 24Y, 24C and 24M have only such end portions at one side in the length direction as connected with the ink tanks 6K, 6Y, 6C and 6M. In this case, between the head units 11, the difference in channel resistance is more likely to become large between the parts of the supply channels 23K, 23Y, 23C and 23M connecting the ink tanks 6K, 6Y, 6C and 6M and the head units 11.

Further, in the first embodiment, the common return channels 27K, 27Y, 27C and 27M have only such end portions at one side in the length direction as connected with the ink tanks 6K, 6Y, 6C and 6M. In this case, between the head units 11, the difference in channel resistance is more likely to become large between the parts of the return channels 26K, 26Y, 26C and 26M connecting the ink tanks 6K, 6Y, 6C and 6M and the head units 11.

In view of these facts, in the first embodiment, by arranging the ink tanks 6K and 6Y at the left side of the ink jet head 2 in the paper width direction and arranging the ink tanks 6C and 6M at the right side of the ink jet head 2 in the paper width direction, as described earlier on, there is a great significance in having no bias of the likelihood to damage the ink meniscus in the nozzles 10 between the six head units 11.

Further, in the first embodiment, the supply channel 23K has the common supply channel 24K extending in the paper width direction as a common channel to the six head units 11, and individual supply channels 25*a*K to 25*f*K connected to the common supply channel 24K as individual channels in the six head units 11. Therefore, the supply channel 23K has longer parts connecting the ink tank 6K and the further rightward head units 11 in the paper width direction. To deal with this, in the first embodiment, among the individual supply channels 25*a*K to 25*f*K, the individual supply channels connected with the parts further away from the parts of the common supply channel 24K connected with the ink tank 6K are configured to have larger areas of the cross sections orthogonal to the length direction, so as to lower the channel resistance per unit length.

By virtue of this, between the head units 11, it is possible to uniformize the channel resistances of the parts connecting the ink tank 6K and the head units 11. Much the same is true on the supply channels 23Y, 23C and 23M.

Further, in the first embodiment, the return channel 26K has the common return channel 27K extending in the paper width direction as a common channel to the six head units 11, and individual return channels 28*a*K to 28*f*K connected to the common return channel 27K as individual channels in the six head units 11. Therefore, the return channel 26K has longer parts connecting the ink tank 6K and the further rightward head units 11 in the paper width direction. To deal with this, in the first embodiment, among the individual return channels 28*a*K to 28*f*K, the individual return channels connected with the parts further away from the parts of the common return channel 24K connected with the ink tank 6K are configured to have larger areas of the cross sections orthogonal to the length direction, so as to lower the channel resistance per unit length.

By virtue of this, between the head units 11, it is possible to uniformize as much as possible the channel resistances of the parts of the return channel 26K connecting the ink tank 6K and the head units 11. Much the same is true on the return channels 26Y, 26C and 26M.

Then, in view of these facts, between the head units 11, it is possible to let such a sum stay within the predetermined range as of the channel resistances of the parts of the supply channel 23K connecting the ink tank 6K and the head units 11 and the channel resistances of the parts of the return channel 26K connecting the ink tank 6K and the head units 11. As a result, when the black ink is circulated between the ink tank 6K and the six head units 11, it is possible to uniformize the ink flow quantity between the head units 11.

In the same manner, when the yellow ink is circulated between the ink tank 6Y and the six head units 11, it is possible to uniformize the ink flow quantity between the head units 11. Still in the same manner, when the cyan ink is circulated between the ink tank 6C and the six head units 11, it is possible to uniformize the ink flow quantity between the head units 11. Still in the same manner, when the magenta ink is circulated between the ink tank 6M and the six head units 11, it is possible to uniformize the ink flow quantity between the head units 11.

Further, in the first embodiment, as described earlier on, the channel resistances of the parts of the supply channels 23K, 23Y, 23C and 23M connecting the ink tanks 6K, 6Y, 6C and 6M and the respective head units 11 are sufficiently smaller than the channel resistances of the ink channels in the head units 11. Therefore, when the inks are circulated between the ink tanks 6K, 6Y, 6C and 6M and the head units 11, it is possible to make the ink pressure change in the supply channels 23K, 23Y, 23C and 23M be sufficiently smaller than the ink pressure change in the head units 11.

Further, in the first embodiment, as described earlier on, the channel resistances of the parts of the return channels 26K, 26Y, 26C and 26M connecting the ink tanks 6K, 6Y, 6C and 6M and the respective head units 11 are sufficiently smaller than the channel resistances of the ink channels in the head units 11. Therefore, when the inks are circulated between the ink tanks 6K, 6Y, 6C and 6M and the head units 11, it is possible to make the ink pressure change in the return channels 26K, 26Y, 26C and 26M be sufficiently smaller than the ink pressure change in the head units 11.

In view of these facts, between the six head units 11, it is possible to reduce as much as possible the difference in the ink pressure in the nozzles 10 when the inks are circulated between the ink tanks 6K, 6Y, 6C and 6M and the head units 11. As a result, between the six head units 11, it is possible to uniformize as much as possible the likelihood to damage the ink meniscus in the nozzles 10.

Further, generally speaking, in the printer 1 jetting the black ink and the color inks, the black ink is used more frequently than the color inks (of yellow, cyan, and magenta). Therefore, in the first embodiment, as described earlier on, the channel resistances of the parts, of the supply channel 23K where the black ink flows, connecting the ink tank 6K and the respective head units 11, are made smaller than the channel resistances of the parts, of the supply channels 23Y, 23C and 23M where the color inks flow, connecting the ink tanks 6Y, 6C and 6M and the respective head units 11. Further, the channel resistances of the parts, of the return channel 26K where the black ink flows, connecting the ink tank 6K and the respective head units 11, are made smaller than the channel resistances of the parts, of the return channels 26Y, 26C and 26M where the color inks flow, connecting the ink tanks 6Y, 6C and 6M and the respective head units 11. By virtue of this, it is possible to make the black ink flow more easily in the ink channels where the black ink flows at a higher frequency of usage.

Second Embodiment

Next, a second embodiment of the present teaching will be explained. However, because the second embodiment differs from the first embodiment only in the configuration of the channels connecting the ink tanks 6K, 6Y, 6C and 6M and the head units 11, that configuration of the channels will be mainly explained below.

<Supply Channels 101K and 101Y>

Figure 6:
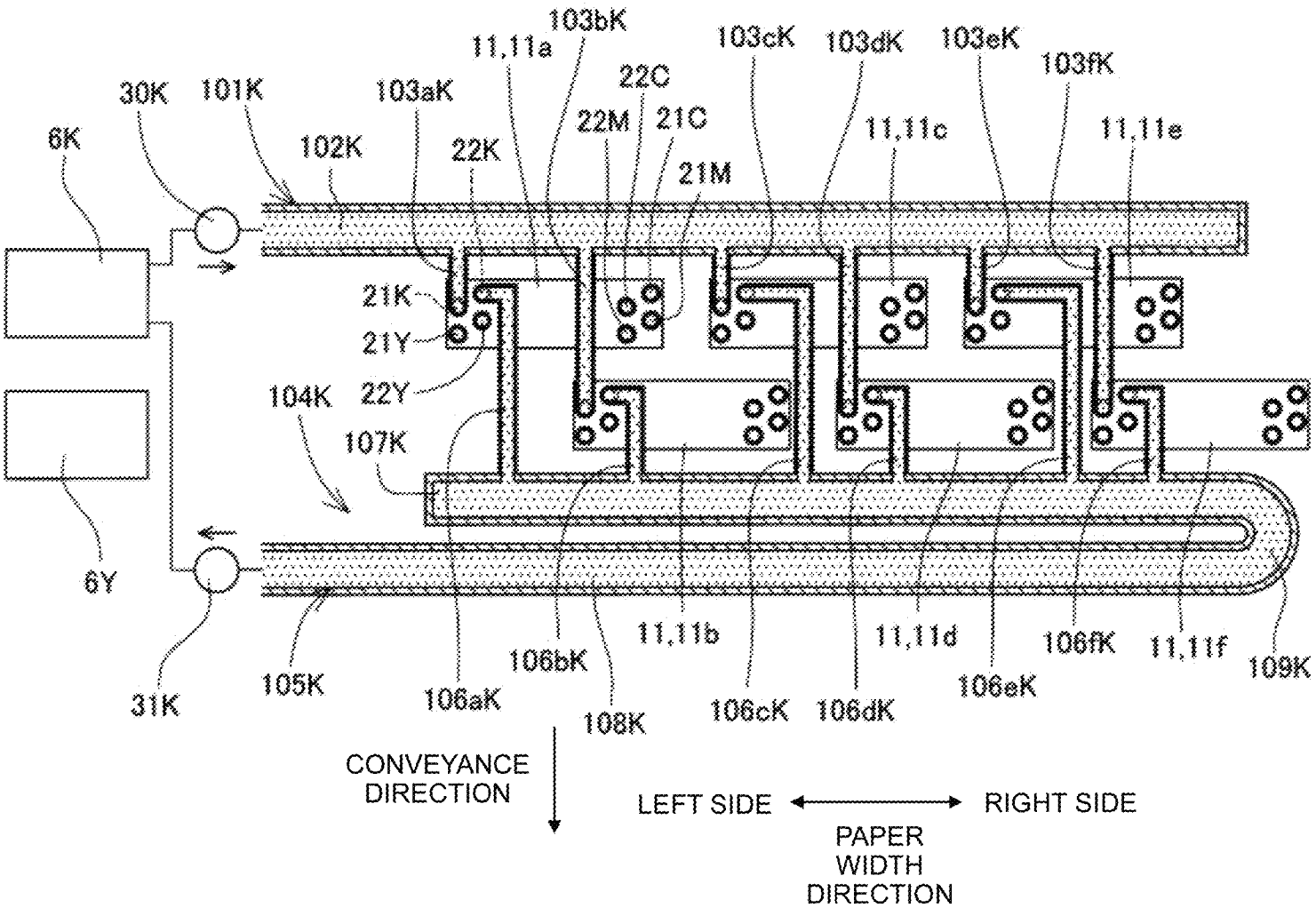
FIG. 6 depicts a configuration of a channel connecting the black ink tank and the head units according to a second embodiment.
Figure 7:
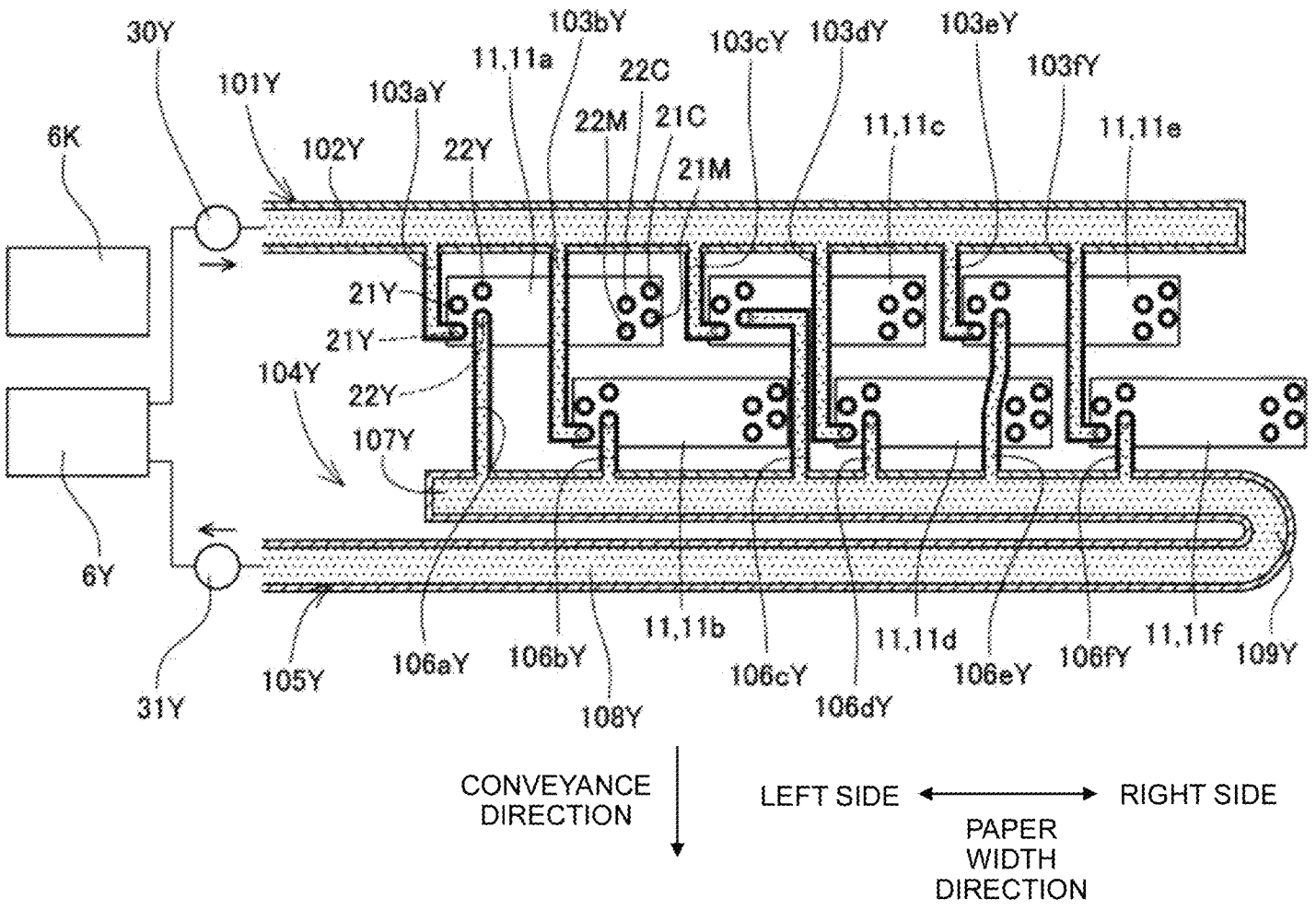
FIG. 7 depicts a configuration of a channel connecting the yellow ink tank and the head units according to the second embodiment.

As depicted in FIGS. 6 and 7, in the second embodiment, the ink tanks 6K and 6Y are connected with the six supply ports 21K and 21Y of the six head units 11, respectively, via supply channels 101K and 101Y. The supply channels 101K and 101Y have common supply channels 102K and 102Y, individual supply channels 103*a*K to 103*f*K and 103*a*Y to 103*f*Y, respectively.

The common supply channels 102K and 102Y are similar to the common supply channels 24K and 24Y in the first embodiment: the left ends thereof are connected respectively with the ink tanks 6K and 6Y via the supply side pumps 30K and 30Y. The individual supply channels 103*a*K to 103*f*K and 103*a*Y to 103*f*Y correspond respectively to the six head units 11*a* to 11*f*, and respectively connect the common supply channels 102K and 102Y and the supply ports 21K and 21Y of the head units 11*a* to 11*f*.

<Return Channels 104K and 104Y>

As depicted in FIGS. 6 and 7, in the second embodiment, the ink tanks 6K and 6Y are connected with the six discharge ports 22K and 22Y of the six head units 11, respectively, via return channels 104K and 104Y. The return channels 104K and 104Y have common return channels 105K and 105Y, individual return channels 106*a*K to 106*f*K and 106*a*Y to 106*f*Y, respectively.

Each of the common return channels 105K and 105Y has three channel parts 107K to 109K and 107Y to 109Y. The channel parts 107K, 108K, 107Y, and 108Y extend in the paper width direction across the six head units 11. Further, the channel part 107K and the channel part 108K and the channel part 107Y and the channel part 108Y align respectively in the conveyance direction. Note that the channel part 107K and the channel part 108K and the channel part 107Y and the channel part 108Y may align respectively in another direction orthogonal to the conveyance direction such as in an up/down direction or the like. The channel parts 109K and 109Y connect, respectively, the pair of right ends of the channel part 107K and the channel part 108K in the paper width direction, and the pair of right ends of the channel part 107Y and the channel part 108Y in the paper width direction. Further, the channel parts 108K and 108Y are connected respectively with the ink tanks 6K and 6Y via the discharge side pumps 31K and 31Y at the left ends in the paper width direction.

The individual return channels 106*a*K to 106*f*K and 106*a*Y to 106*f*Y correspond respectively to the six head units

11*a* to 11*f*, and respectively connect the channel parts 107K and 107Y of the common return channels 105K and 105Y and the discharge ports 22K and 22Y of the head units 11*a* to 11*f*.

<Supply Channels 101C and 101M>

Figure 8:
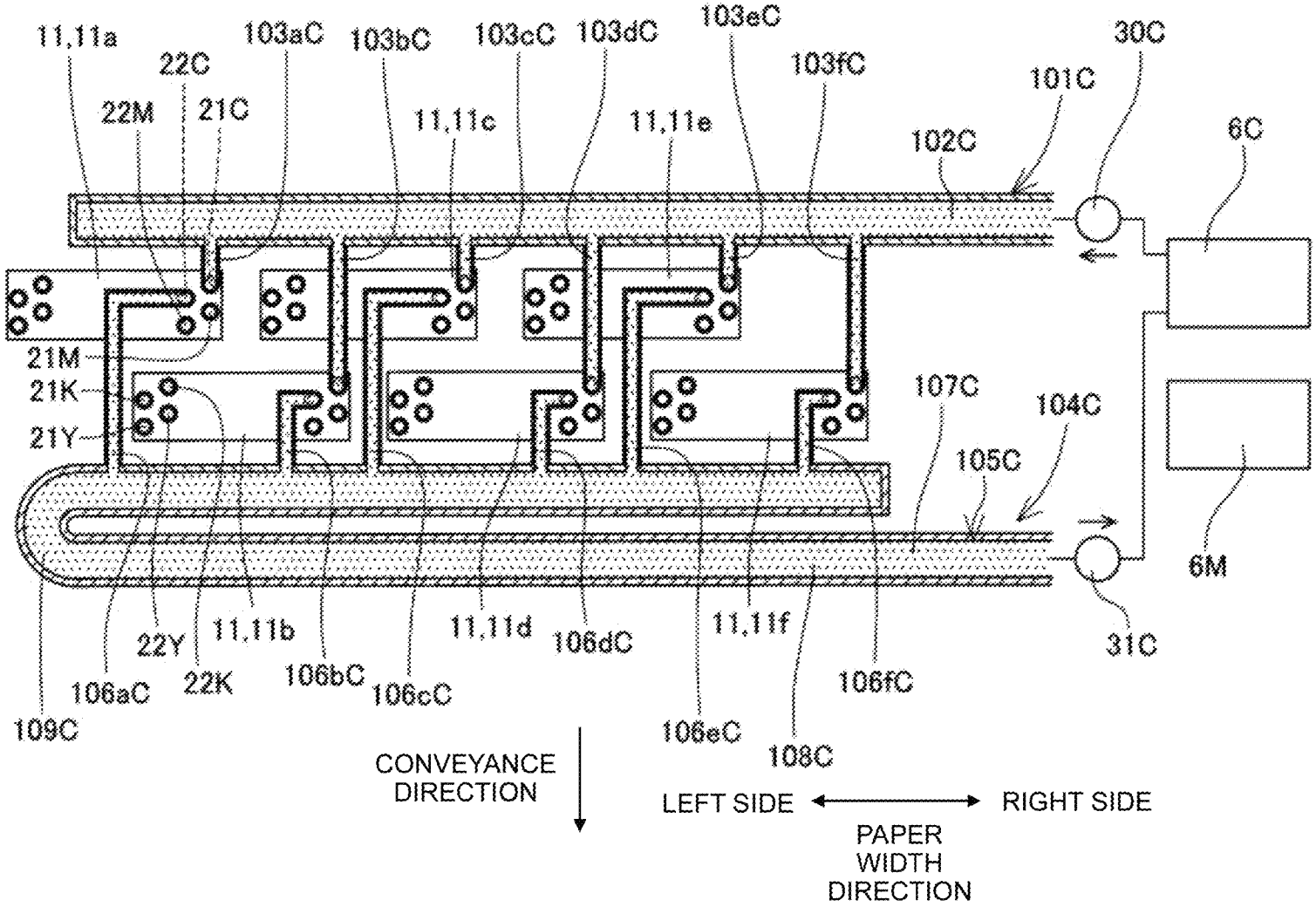
FIG. 8 depicts a configuration of a channel connecting the cyan ink tank and the head units according to the second embodiment.
Figure 9:
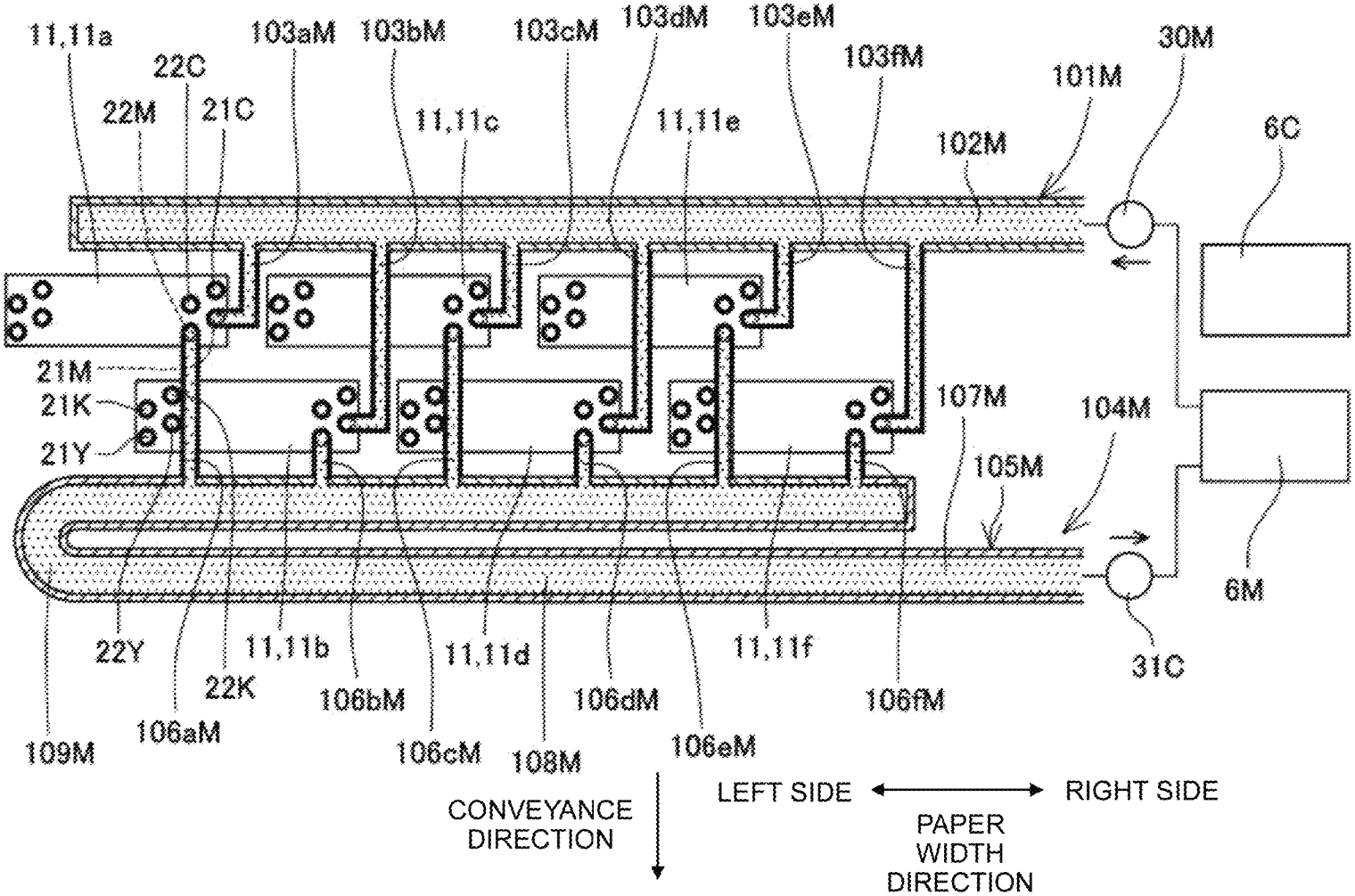
FIG. 9 depicts a configuration of a channel connecting the magenta ink tank and the head units according to the second embodiment.

As depicted in FIGS. 8 and 9, in the second embodiment, the ink tanks 6C and 6M are connected with the six supply ports 21C and 21M of the six head units 11, respectively, via supply channels 101C and 101M. The supply channels 101C and 101M have common supply channels 102C and 102M, individual supply channels 103*a*C to 103*f*C and 103*a*M to 103*f*M, respectively.

The common supply channels 102C and 102M are similar to the common supply channels 24C and 24M in the first embodiment: the right ends thereof are connected respectively with the ink tanks 6C and 6M via the supply side pumps 30C and 30M. The individual supply channels 103*a*C to 103*f*C and 103*a*M to 103*f*M correspond respectively to the six head units 11*a* to 11*f*, and respectively connect the common supply channels 102C and 102M and the supply ports 21C and 21M of the head units 11*a* to 11*f*.

<Return Channels 104C and 104M>

As depicted in FIGS. 8 and 9, in the second embodiment, the ink tanks 6C and 6M are connected with the six discharge ports 22C and 22M of the six head units 11, respectively, via return channels 104C and 104M. The return channels 104C and 104M have common return channels 105C and 105M, individual return channels 106*a*C to 106*f*C and 106*a*M to 106*f*M, respectively.

Each of the common return channels 105C and 105M has three channel parts 107C to 109C and 107M to 109M. The channel parts 107C, 108C, 107M, and 108M extend in the paper width direction across the six head units 11. Further, the channel part 107C and the channel part 108C and the channel part 107M and the channel part 108M align respectively in the conveyance direction. Note that the channel part 107C and the channel part 108C and the channel part 107M and the channel part 108M may align respectively in another direction orthogonal to the conveyance direction such as in the up/down direction or the like. The channel parts 109C and 109M connect, respectively, the pair of left ends of the channel part 107C and the channel part 108C in the paper width direction, and the pair of left ends of the channel part 107M and the channel part 108M in the paper width direction. Further, the channel parts 108C and 108M are connected respectively with the ink tanks 6C and 6M via the discharge side pumps 31C and 31M at the right ends in the paper width direction.

The individual return channels 106*a*C to 106*f*C and 106*a*M to 106*f*M correspond respectively to the six head units 11*a* to 11*f*, and respectively connect the channel parts 107C and 107M of the common return channels 105C and 105M and the discharge ports 22C and 22M of the head units 11*a* to 11*f*.

<Magnitude Relation of the Sum of Channel Resistances of Supply Channels and Return Channels Between the Head Units 11>

In the second embodiment, the areas of the cross sections of the individual supply channels 103*a*K to 103*f*K orthogonal to the length direction are almost the same. Further, as described earlier on, the lengths of the individual supply channels 103*a*K to 103*f*K are almost the same. Therefore, the channel resistances of the individual supply channels 103*a*K to 103*f*K are almost the same.

On the other hand, in the common supply channel 102K, the lengths of the parts connecting the ink tank 6K and the individual supply channels 103*a*K to 103*f*K are longer with those corresponding to the head units 11 positioned further rightward in the paper width direction. That is, the common supply channel 102K has larger channel resistances in the parts of connecting such ones of the ink tank 6K and the individual supply channels 103*a*K to 103*f*K as positioned further rightward in the paper width direction.

Further, in the second embodiment, the areas of the cross sections of the individual return channels 106*a*K to 106*f*K orthogonal to the length direction are almost the same. Further, as described earlier on, the lengths of the individual return channels 106*a*K to 106*f*K are almost the same. Therefore, the channel resistances of the individual return channels 106*a*K to 106*f*K are almost the same.

On the other hand, in the common return channel 105K, the lengths of the parts connecting the ink tank 6K and the individual return channels 106*a*K to 106*f*K are longer with those corresponding to the head units 11 positioned further leftward in the paper width direction. That is, the common return channel 105K has larger channel resistances in the parts of connecting such ones of the ink tank 6K and the individual return channels 105*a*K to 105*f*K as positioned further leftward in the paper width direction.

In view of these facts, in the second embodiment, the supply channel 101K has larger channel resistances in the parts of connecting the ink tank 6K and the head units 11 positioned further rightward in the paper width direction. Further, the return channel 104K has smaller channel resistances in the parts of connecting the ink tank 6K and the head units 11 positioned further rightward in the paper width direction. By virtue of this, then, between the six head units 11, such a difference stays within a predetermined range (within the range of ±5%, for example) as in the sum of the channel resistances of the parts of the supply channel 101K connecting the ink tank 6K and the head units 11, and the channel resistances of the parts of the return channel 104K connecting the ink tank 6K and the head units 11.

Further, in the second embodiment, the areas of the cross sections (channel resistances) of the individual supply channels 103*a*Y to 103*f*Y, 103*a*C to 103*f*C, and 103*a*M to 103*f*M orthogonal to the length direction are almost the same, respectively. Further, the areas of the cross sections (channel resistances) of the individual return channels 106*a*Y to 106*f*Y, 106*a*C to 106*f*C, and 106*a*M to 106*f*M orthogonal to the length direction are almost the same, respectively.

Therefore, as described earlier on, the supply channels 101Y, 101C and 101M have larger channel resistances in the parts of connecting the ink tanks 6Y, 6C and 6M and the head units 11 positioned further rightward in the paper width direction. Further, the return channels 104Y, 104C and 104M have smaller channel resistances in the parts of connecting the ink tanks 6Y, 6C and 6M and the head units 11 positioned further rightward in the paper width direction.

By virtue of this, between the six head units 11, such a difference stays within a predetermined range as in the sum of the channel resistances of the parts of the supply channel 101Y connecting the ink tank 6Y and the head units 11, and the channel resistances of the parts of the return channel 104Y connecting the ink tank 6Y and the head units 11.

By virtue of this, between the six head units 11, such a difference stays within a predetermined range as in the sum of the channel resistances of the parts of the supply channel 101C connecting the ink tank 6C and the head units 11, and the channel resistances of the parts of the return channel 104C connecting the ink tank 6C and the head units 11.

By virtue of this, between the six head units 11, such a difference stays within a predetermined range as in the sum of the channel resistances of the parts of the supply channel 101M connecting the ink tank 6M and the head units 11, and the channel resistances of the parts of the return channel 104M connecting the ink tank 6M and the head units 11.

<Magnitude Relation of Channel Resistances Between Supply Channels and Between Return Channels>

Further, in the second embodiment, the cross sectional areas S3K of the cross sections of the individual supply channels 103aK to 103fK where the black ink flows and which are orthogonal to their length direction are larger than the cross sectional areas S3Y, S3C and S3M of the cross sections of the individual supply channels 103aY to 103fY, 103aC to 103fC and 103aM to 103fM where the color inks flow and which are orthogonal to their length direction. Further, the cross sectional areas S3Y, S3C and S3M of the individual supply channels 103aY to 103fY, 103aC to 103fC and 103aM to 103fM are almost the same.

Further, in the second embodiment, the cross sectional area R3K of the cross section of the common supply channels 102K where the black ink flows and which is orthogonal to its length direction is larger than the cross sectional areas R3Y, R3C and R3M of the cross sections of the common supply channels 102Y, 102C and 102M where the color inks flow and which are orthogonal to their length direction. Further, the cross sectional areas R3Y, R3C and R3M of the common supply channels 102Y, 102C and 102M are almost the same.

In view of these facts, the parts of the supply channel 101K connecting the ink tank 6K and the respective head units 11 have smaller channel resistances than the parts of the supply channels 101Y, 101C and 101M connecting the respective head units 11 and the ink tanks 6Y, 6C and 6M.

<Magnitude Relation of Channel Resistances Between Return Channels>

Further, in the second embodiment, the cross sectional areas S4K of the cross sections of the individual return channels 106aK to 106fK where the black ink flows and which are orthogonal to their length direction are larger than the cross sectional areas S4Y, S4C and S4M of the cross sections of the individual return channels 106aY to 106fY, 106aC to 106fC and 106aM to 106fM where the color inks flow and which are orthogonal to their length direction. Further, the cross sectional areas S4Y, S4C and S4M of the individual return channels 106aY to 106fY, 106aC to 106fC and 106aM to 106fM are almost the same.

Further, in the second embodiment, the cross sectional area R4K of the cross section of the common return channels 105K where the black ink flows and which is orthogonal to its length direction is larger than the cross sectional areas R4Y, R4C and R4M of the cross sections of the common return channels 105Y, 105C and 105M where the color inks flow and which are orthogonal to their length direction. Further, the cross sectional areas R4Y, R4C and R4M of the common return channels 105Y, 105C and 105M are almost the same.

In view of these facts, the parts of the return channel 104K connecting the ink tank 6K and the respective head units 11 have smaller channel resistances than the parts of the return channels 104Y, 104C and 104M connecting the respective head units 11 and the ink tanks 6Y, 6C and 6M.

<Magnitude Relation of Channel Resistances Between the Supply Channels and Return Channels, and the Head Units 11>

Further, in the second embodiment, the parts of the supply channels 101K, 101Y, 101C and 101M and the return channels 104K, 104Y, 104C and 104M connecting the ink tanks 6K, 6Y, 6C and 6M and the head units 11 have such sufficiently small channel resistances as, for example, 1/100 of those of the ink channels inside the head units 11 including the nozzles 10.

Further, in the second embodiment, between any two head units 11 of the six head units 11, the head unit 11 arranged at the left side in the paper width direction corresponds to the "first liquid jetting head" of the present teaching, whereas the head unit 11 arranged at the right side in the paper width direction corresponds to the "second liquid jetting head" of the present teaching.

Then, the individual supply channels for the black and yellow inks corresponding to the first liquid jetting head are connected to closer parts to the connected parts of the common supply channels 102K and 102Y with the ink tanks 6K and 6Y than the individual supply channels for the black and yellow inks corresponding to the second liquid jetting head. By virtue of this, the channel resistances of the parts of the supply channels 101K and 101Y connecting the ink tanks 6K and 6Y and the first liquid jetting head are smaller than the channel resistances of the parts connecting the ink tanks 6K and 6Y and the second liquid jetting head.

Further, the individual supply channels for the cyan and magenta inks corresponding to the first liquid jetting head are connected to farther parts from the connected parts of the common supply channels 102C and 102M with the ink tanks 6K and 6Y than the individual supply channels for the cyan and magenta inks corresponding to the second liquid jetting head. By virtue of this, the channel resistances of the parts of the supply channels 101C and 101M connecting the ink tanks 6C and 6M and the first liquid jetting head are larger than the channel resistances of the parts connecting the ink tanks 6C and 6M and the second liquid jetting head.

Further, the individual return channels for the black and yellow inks corresponding to the first liquid jetting head are connected to farther parts from the connected parts of the common return channels 105K and 105Y with the ink tanks 6K and 6Y than the individual return channels for the black and yellow inks corresponding to the second liquid jetting head. By virtue of this, the channel resistances of the parts of the return channels 104K and 104Y connecting the ink tanks 6K and 6Y and the first liquid jetting head are larger than the channel resistances of the parts connecting the ink tanks 6K and 6Y and the second liquid jetting head.

Further, the individual return channels for the cyan and magenta inks corresponding to the first liquid jetting head are connected to closer parts to the connected parts of the common return channels 105C and 105M with the ink tanks 6K and 6Y than the individual supply channels for the cyan and magenta inks corresponding to the second liquid jetting head. By virtue of this, the channel resistances of the parts of the return channels 104C and 104M connecting the ink tanks 6C and 6M and the first liquid jetting head are smaller than the channel resistances of the parts connecting the ink tanks 6C and 6M and the second liquid jetting head.

[Effects]

In the second embodiment, too, the ink jet head 2 has six head units 11 aligning in the paper width direction while the ink tanks 6K and 6Y are arranged at the left side of the ink jet head 2 in the paper width direction and the ink tanks 6C and 6M are arranged at the right side of the ink jet head 2 in the paper width direction. By virtue of this, in the same manner as explained in the first embodiment, between the six head units 11, it is possible to have no bias in the likelihood to damage the ink meniscus in the nozzles 10.

Further, in the second embodiment, too, the common supply channels 102K, 102Y, 102C and 102M have only such end portions at one side in the length direction as connected with the ink tanks 6K, 6Y, 6C and 6M while the common return channels 105K, 105Y, 105C and 105M have only such end portions at one side in the length direction as connected with the ink tanks 6K, 6Y, 6C and 6M. Therefore, in the second embodiment, too, in the same manner as explained in the first embodiment, by arranging the ink tanks 6K and 6Y at the left side of the ink jet head 2 in the paper width direction and arranging the ink tanks 6C and 6M at the right side of the ink jet head 2 in the paper width direction, as described earlier on, there is a great significance in having no bias of the likelihood to damage the ink meniscus in the nozzles 10 between the six head units 11.

Further, in the second embodiment, the supply channel 101K has larger channel resistances in the parts of connecting the ink tank 6K and the head units 11 positioned further rightward in the paper width direction, while the return channel 104K has smaller channel resistances in the parts of connecting the ink tank 6K and the head units 11 positioned further rightward in the paper width direction. By virtue of this, between the head units 11, it is possible to let such a sum stay within the predetermined range as of the channel resistances of the parts of the supply channel 101K connecting the ink tank 6K and the head units 11 and the channel resistances of the parts of the return channel 104K connecting the ink tank 6K and the head units 11. As a result, when the black ink is circulated between the ink tank 6K and the six head units 11, it is possible to uniformize the ink flow quantity between the head units 11.

In the same manner, when the yellow ink is circulated between the ink tank 6Y and the six head units 11, it is possible to uniformize the ink flow quantity between the head units 11. Still in the same manner, when the cyan ink is circulated between the ink tank 6C and the six head units 11, it is possible to uniformize the ink flow quantity between the head units 11. Still in the same manner, when the magenta ink is circulated between the ink tank 6M and the six head units 11, it is possible to uniformize the ink flow quantity between the head units 11.

Further, in the second embodiment, too, the channel resistances of the parts of the supply channels 101K, 101Y, 101C and 101M and the return channels 104K, 104Y, 104C and 104M connecting the ink tanks 6K, 6Y, 6C and 6M and the respective head units 11 are sufficiently smaller than the channel resistances of the ink channels in the head units 11. Therefore, in the same manner as described in the first embodiment, between the six head units 11, it is possible to reduce as much as possible the difference in the ink pressure in the nozzles 10 when the inks are circulated between the ink tanks 6K, 6Y, 6C and 6M and the head units 11. As a result, between the six head units 11, it is possible to uniformize as much as possible the likelihood to damage the ink meniscus in the nozzles 10.

Further, in the second embodiment, too, the channel resistances of the parts, of the supply channel 101K where the black ink flows, connecting the ink tank 6K and the respective head units 11, are made smaller than the channel resistances of the parts, of the supply channels 101Y, 101C and 101M where the color inks flow, connecting the ink tanks 6Y, 6C and 6M and the respective head units 11. Further, the channel resistances of the parts, of the return channel 104K where the black ink flows, connecting the ink tank 6K and the respective head units 11, are made smaller than the channel resistances of the parts, of the return channels 104Y, 104C and 104M where the color inks flow, connecting the ink tanks 6Y, 6C and 6M and the respective head units 11. By virtue of this, in the same manner as explained in the first embodiment, it is possible to make the black ink flow more easily in the ink channels where the black ink flows at a higher frequency of usage.

Modified Embodiments

Whereas the first embodiment and the second embodiment were explained above, the present teaching is not limited to the first and second embodiments but can be changed and modified in various manners as far as within the scope of the appended claims.

In the first and second embodiments, the common supply channels have only such end portions at one side in the length direction as connected with the ink tanks while the common return channels have only such end portions at one side in the length direction as connected with the ink tanks. However, without being limited to that, the end portions of the common supply channels at both sides in the length direction may be connected with the ink tanks. Further, the end portions of the common return channels at both sides in the length direction may be connected with the ink tanks.

Further, in the first and second embodiments, the channel resistances of the parts, of the supply channel where the black ink flows, connecting the ink tank 6K and the respective head units 11, are made smaller than the channel resistances of the parts, of the supply channels where the color inks flow, connecting the ink tanks 6Y, 6C and 6M and the respective head units 11. However, without being limited to that, for example, those channel resistances may all be let at almost the same degree.

Further, in the first and second embodiments, the channel resistances of the parts, of the return channel where the black ink flows, connecting the ink tank 6K and the respective head units 11, are made smaller than the channel resistances of the parts, of the return channels where the color inks flow, connecting the ink tanks 6Y, 6C and 6M and the respective head units 11. However, without being limited to that, for example, those channel resistances may all be let at almost the same degree.

Further, in the second embodiment, the parts of the supply channels and return channels connecting the ink tanks 6K, 6Y, 6C and 6M and the head units 11 have such sufficiently small channel resistances as, for example, 1/100 or less than 1/100 of those of the ink channels inside the head units 11. However, without being limited to that, for example, the parts of the supply channels connecting the ink tanks 6K, 6Y, 6C and 6M and the head units 11 may have such channel resistances as more than 1/100 of those of the ink channels inside the head units 11. Alternatively, for example, the parts of the return channels connecting the ink tanks 6K, 6Y, 6C and 6M and the head units 11 may have such channel resistances as more than 1/100 of those of the ink channels inside the head units 11.

Further, in the first embodiment, the supply channel 23K has the individual supply channels 25*a*K to 25*f*K of the same length as the common supply channel 24K, while between the individual supply channels 25*a*K to 25*f*K, there are different cross sectional areas orthogonal to the length direction, such that between the head units 11, there is a uniform channel resistance of the parts of the supply channel 23K connecting the ink tank 6K and the head units 11. However, the present teaching is not limited to that.

For example, the ink tank 6K may be connected individually with the supply port 21K of each head unit 11 through a tube or the like. In such a case, the whole length of the connected members depends on the tube connected with the supply port 21K of the head unit 11 at the right side in the paper width direction. Hence, the cross sectional area orthogonal to the length direction may be made as large (to reduce the channel resistance per unit length) as in proportion to the tube connected with the supply port 21K of the head unit 11 at the right side in the paper width direction. Much the same is true on the supply channels connecting the ink tank 6Y and the supply ports 21Y of the head units 11.

In the same manner, the ink tank 6C may be connected individually with the supply port 21C of each head unit 11 through a tube or the like. In such a case, the whole length of the connected members depends on the tube connected with the supply port 21C of the head unit 11 at the left side in the paper width direction. Hence, the cross sectional area orthogonal to the length direction may be made as large (to reduce the channel resistance per unit length) as in proportion to the tube connected with the supply port 21C of the head unit 11 at the left side in the paper width direction. Much the same is true on the supply channels connecting the ink tank 6M and the supply ports 21M of the head units 11.

Further, in the first embodiment, the return channel 26K has the individual supply channels 28*a*K to 28*f*K and the common return channel 27K, while between the individual return channels 28*a*K to 28*f*K, there are different cross sectional areas orthogonal to the length direction, such that between the head units 11, there is a uniform channel resistance of the parts of the return channel 26K connecting the ink tank 6K and the head units 11. However, the present teaching is not limited to that.

For example, the ink tank 6K may be connected individually with the discharge port 22K of each head unit 11 through a tube or the like. In such a case, the whole length of the connected members depends on the tube connected with the discharge port 22K of the head unit 11 at the right side in the paper width direction. Hence, the cross sectional area orthogonal to the length direction may be made as large (to reduce the channel resistance per unit length) as in proportion to the tube connected with the discharge port 22K of the head unit 11 at the right side in the paper width direction. Much the same is true on the channels connecting the ink tank 6Y and the discharge ports 22Y of the head units 11.

In the same manner, the ink tank 6C may be connected individually with the discharge port 22C of each head unit 11 through a tube or the like. In such a case, the whole length of the connected members depends on the tube connected with the discharge port 22C of the head unit 11 at the right side in the paper width direction. Hence, the cross sectional area orthogonal to the length direction may be made as large (to reduce the channel resistance per unit length) as in proportion to the tube connected with the discharge port 22C of the head unit 11 at the right side in the paper width direction. Much the same is true on the supply channels connecting the ink tank 6M and the discharge ports 22M of the head units 11.

With those configurations different from the examples in the embodiments explained earlier on, between the head units 11, it is possible to let such a sum stay within the predetermined range as of the channel resistances of the parts of the supply channel connecting the ink tank and the head units 11 and the channel resistances of the parts of the return channel connecting the ink tank and the head units 11.

Further, in the first embodiment, in the supply channels 23K, 23Y, 23C and 23M, there are made the uniform channel resistances of the parts connecting the ink tanks 6K, 6Y, 6C and 6M and the respective head units 11, respectively. In addition, in the return channels 26K, 26Y, 26C and 26M, there are made as much as possible the uniform channel resistances of the parts connecting the ink tanks 6K, 6Y, 6C and 6M and the respective head units 11, respectively. However, without being limited to that, for example, in the return channels 26K, 26Y, 26C and 26M, there may be a difference to some degree in channel resistance between the parts connecting the ink tanks 6K, 6Y, 6C and 6M and the respective head units 11, respectively.

Further, in the first and second embodiments, there may be a difference to some degree in channel resistance both between the parts of the supply channels connecting the ink tanks 6K, 6Y, 6C and 6M and the respective head units 11, and between the parts of the return channels connecting the ink tanks 6K, 6Y, 6C and 6M and the respective head units 11.

In this case, if the ink tanks 6K, 6Y, 6C and 6M are all arranged only at one side of the ink jet head in the paper width direction, then a further noticeable bias will arise as follows: the aforementioned parts thereof connected with any of the head units 11 will all become large or all become small in channel resistance.

Therefore, in this case, too, by arranging the ink tanks 6K and 6Y at the left side of the ink jet head 2 in the paper width direction and arranging the ink tanks 6C and 6M at the right side of the ink jet head 2 in the paper width direction, in the same manner as described earlier on, between the six head units 11, it is possible to bring about no bias in the likelihood to damage the ink meniscus in the nozzles 10.

Further, in the first and second embodiments, the ink jet head 2 jets the four color inks of black, yellow, cyan and magenta, where the ink tanks 6K and 6Y retaining the black and yellow inks are arranged at the left side of the ink jet head 2 in the paper width direction while the ink tanks 6C and 6M retaining the cyan and magenta inks are arranged at the right side of the ink jet head 2 in the paper width direction. However, the present teaching is not limited to that.

For example, in the printer, an ink jet head jetting the two color inks of black and yellow may align in the conveyance direction with an ink jet head jetting the two color inks of cyan and magenta. Then, the ink tank retaining the black ink and the ink tank retaining the yellow ink may be respectively arranged at one side and the other side of the ink tanks retaining the black and yellow inks. Further, the ink tank retaining the cyan ink and the ink tank retaining the magenta ink may be respectively arranged at one side and the other side of the ink tanks retaining the cyan and magenta inks.

Further, in the above examples, the ink tanks are arranged at the right side and the left side of the ink jet head in the paper width direction. However, without being limited to that, for example, the ink tanks may be arranged in positions overlapping with the ink jet head in the up/down direction or the conveyance direction, and the ink tanks may be arranged to deviate from each other in the paper width direction.

Further, in the above examples, the present teaching is applied to a printer including an ink jet head jetting black and color inks from nozzles. However, without being limited to that, for example, it is also possible to apply the present teaching to such liquid jetting apparatuses other than printers as to include a liquid jetting head jetting first and second liquids other than inks such as liquidized metal, resin, or the like.

What is claimed is:

1. A liquid jetting apparatus comprising:

liquid jetting heads which are arranged along a predetermined arrangement direction and each of which has a first nozzle to jet a first liquid and a second nozzle to jet a second liquid;

a first tank in which the first liquid is stored;

a second tank in which the second liquid is stored;

first supply channels which connect the first tank and the liquid jetting heads to supply the first liquid from the first tank to the liquid jetting heads;

second supply channels which connect the second tank and the liquid jetting heads to supply the second liquid from the second tank to the liquid jetting heads;

first return channels which connect the liquid jetting heads and the first tank to return the first liquid from the liquid jetting heads to the first tank; and second return channels which connect the liquid jetting heads and the second tank to return the second liquid from the liquid jetting heads to the second tank, wherein the first tank and the second tank are arranged to deviate from each other in the arrangement direction, wherein the first tank is arranged on one side in the arrangement direction with respect to the liquid jetting heads, the second tank is arranged on the other side in the arrangement direction with respect to the liquid jetting heads, wherein the liquid jetting heads include a first liquid jetting head and a second liquid jetting head arranged on the other side in the arrangement direction with respect to the first liquid jetting head, among the first supply channels, a first supply channel connecting the first tank and the second liquid jetting head is longer than a first supply channel connecting the first tank and the first liquid jetting head, and has a smaller average channel resistance per unit length than the first supply channel connecting the first tank and the first liquid jetting head, and among the second supply channels, a second supply channel connecting the second tank and the first liquid jetting head is longer than a second supply channel connecting the second tank and the second liquid jetting head, and has a smaller average channel resistance per unit length than the second supply channel connecting the second tank and the second liquid jetting head.

2. The liquid jetting apparatus according to claim 1, wherein the first supply channels are formed of: a first common supply channel connected to the first tank and extending in the arrangement direction; and first individual supply channels connecting the first common supply channel and the liquid jetting heads, the second supply channels are formed of: a second common supply channel connected to the second tank and extending in the arrangement direction; and second individual supply channels connecting the second common supply channel and the liquid jetting heads, a connecting part between the first common supply channel and a first individual supply channel connected to the second liquid jetting head is farther away from the first tank than a connecting part between the first common supply channel and a first individual supply channel connected to the first liquid jetting head, a cross sectional area, of the first individual supply channel connected to the second liquid jetting head, which is orthogonal to a longitudinal direction of the first individual supply channel connected to the second liquid jetting head is larger than a cross sectional area, of the first individual supply channel connected to the first liquid jetting head, which is orthogonal to a longitudinal direction of the first individual supply channel connected to the first liquid jetting head, a connecting part between the second common supply channel and a second individual supply channel connected to the first liquid jetting head is farther away from the second tank than a connecting part between the second common supply channel and a second individual supply channel connected to the second liquid jetting head, and a cross sectional area, of the second individual supply channel connected to the first liquid jetting head, which is orthogonal to a longitudinal direction of the second individual supply channel connected to the first liquid jetting head is larger than a cross sectional area, of the second individual supply channel connected to the second liquid jetting head, which is orthogonal to a longitudinal direction of the second individual supply channel connected to the second liquid jetting head.

3. A liquid jetting apparatus comprising:

liquid jetting heads which are arranged along a predetermined arrangement direction and each of which has a first nozzle to jet a first liquid and a second nozzle to jet a second liquid;

a first tank in which the first liquid is stored;

a second tank in which the second liquid is stored;

first supply channels which connect the first tank and the liquid jetting heads to supply the first liquid from the first tank to the liquid jetting heads;

second supply channels which connect the second tank and the liquid jetting heads to supply the second liquid from the second tank to the liquid jetting heads;

first return channels which connect the liquid jetting heads and the first tank to return the first liquid from the liquid jetting heads to the first tank; and second return channels which connect the liquid jetting heads and the second tank to return the second liquid from the liquid jetting heads to the second tank, wherein the first tank and the second tank are arranged to deviate from each other in the arrangement direction, wherein the first tank is arranged on one side in the arrangement direction with respect to the liquid jetting heads, and the second tank is arranged on the other side in the arrangement direction with respect to the liquid jetting heads, wherein the liquid jetting heads include a first liquid jetting head, and a second liquid jetting head arranged on the other side in the arrangement direction with respect to the first liquid jetting head, among the first return channels, a first return channel connecting the first tank and the second liquid jetting head is longer than a first return channel connecting the first tank and the first liquid jetting head, and has a smaller average channel resistance per unit length than the first return channel connecting the first tank and the first liquid jetting head, and among the second return channels, a second return channel connecting the second tank and the first liquid jetting head is longer than a second return channel connecting the second tank and the second liquid jetting head, and has a smaller average channel resistance per unit length than the second return channel connecting the second tank and the second liquid jetting head.

4. The liquid jetting apparatus according to claim 3, wherein the first return channels are formed of: a first common return channel connected to the first tank and extending in the arrangement direction; and first individual return channels connecting the first common return channel and the liquid jetting heads, the second return channels are formed of: a second common return channel connected to the second tank and extending in the arrangement direction; and second individual return channels connecting the second common return channel and the liquid jetting heads, a connecting part between the first common return channel and a first individual return channel connected to the first liquid jetting head is farther away from the first tank than a connecting part between the first common return channel and a first individual return channel connected to the second liquid jetting head, a cross sectional area, of the first individual return channel connected to the first liquid jetting head, which is orthogonal to a longitudinal direction of the first individual return channel connected to the first liquid jetting head is larger than a cross sectional area, of the first individual return channel connected to the second liquid jetting head, which is orthogonal to a longitudinal direction of the first individual return channel connected to the second liquid jetting head, a connecting part between the second common return channel and a second individual return channel connected to the second liquid jetting head is farther away from the second tank than a connecting part between the second common return channel and a second individual return channel connected with the first liquid jetting head, and a cross sectional area, of the second individual return channel connected to the second liquid jetting head, which is orthogonal to a longitudinal direction of the second individual return channel connected to the second liquid jetting head is larger than a cross sectional area, of the second individual return channel connected to the first liquid jetting head, which is orthogonal to a longitudinal direction of the second individual return channel connected to the first liquid jetting head.

5. A liquid jetting apparatus comprising:

liquid jetting heads which are arranged along a predetermined arrangement direction and each of which has a first nozzle to jet a first liquid and a second nozzle to jet a second liquid;

a first tank in which the first liquid is stored;

a second tank in which the second liquid is stored;

first supply channels which connect the first tank and the liquid jetting heads to supply the first liquid from the first tank to the liquid jetting heads;

second supply channels which connect the second tank and the liquid jetting heads to supply the second liquid from the second tank to the liquid jetting heads;

first return channels which connect the liquid jetting heads and the first tank to return the first liquid from the liquid jetting heads to the first tank; and second return channels which connect the liquid jetting heads and the second tank to return the second liquid from the liquid jetting heads to the second tank, wherein the first tank and the second tank are arranged to deviate from each other in the arrangement direction, wherein the liquid jetting heads include a first liquid jetting head and a second liquid jetting head, a first supply channel connecting the first liquid jetting head and the first tank has a smaller channel resistance than a first supply channel connecting the second liquid jetting head and the first tank, and a first return channel connecting the first liquid jetting head and the first tank has a larger channel resistance than a first return channel connecting the second liquid jetting head and the first tank.

6. The liquid jetting apparatus according to claim 5, wherein the first supply channels are formed of: a first common supply channel connected to the first tank; and first individual supply channels connecting the first common supply channel and the liquid jetting heads, the first return channels are formed of: a first common return channel connected to the first tank; and first individual return channels connecting the first common return channel and the liquid jetting heads, a channel length from the first tank to a connecting part between the first common supply channel and a first individual supply channel connected to the first liquid jetting head is shorter than a channel length from the first tank to a connecting part between the first common supply channel and a first individual supply channel connected to the second liquid jetting head, and a channel length from the first tank to a connecting part between the first common return channel and a first individual return channel connected to the first liquid jetting head is longer than a channel length from the first tank to a connecting part between the first common return channel and a first individual return channel connected to the second liquid jetting head.

7. The liquid jetting apparatus according to claim 5, wherein a second supply channel connecting the first liquid jetting head and the second tank has a larger channel resistance than a second supply channel connecting the second liquid jetting head and the second tank, and a second return channel connecting the first liquid jetting head and the second tank has a smaller channel resistance than a second return channel connecting the second liquid jetting head and the second tank.

8. The liquid jetting apparatus according to claim 7, wherein the second supply channels are formed of: a second common supply channel connected to the second tank; and second individual supply channels connecting the second common supply channel and the liquid jetting heads, the second return channels are formed of: a second common return channel connected to the second tank; and second individual return channels connecting the second common return channel and the liquid jetting heads, a channel length from the second tank to a connecting part between the second common supply channel and a second individual supply channel connected to the first liquid jetting head is longer than a channel length from the second tank to a connecting part between the second common supply channel and a second individual supply channel connected to the second liquid jetting head, and a channel length from the second tank to a connecting part between the second common return channel and a second individual return channel connected to the first liquid jetting head is shorter than a channel length from the second tank to a connecting part between the second common return channel and a second individual return channel connected to the second liquid jetting head.

9. The liquid jetting apparatus according to claim 1, wherein channel resistance of each of the first supply channels and channel resistance of each of the second supply channels are 1/100 or less than 1/100 of channel resistance of the channels inside the liquid jetting heads.

10. The liquid jetting apparatus according to claim 1, wherein channel resistance of each of the first return channels and channel resistance of each of the second return channels are 1/100 or less than 1/100 of channel resistance of the channels inside the liquid jetting heads.

11. The liquid jetting apparatus according to claim 1, wherein the first liquid is a black ink, the second liquid is a color ink, for each liquid jetting head, channel resistance of a first supply channel connected to the liquid jetting head is smaller than channel resistance of a second supply channel connected to the liquid jetting head, and for each liquid jetting head, channel resistance of a first return channel connected to the liquid jetting head is smaller than channel resistance of a second return channel connected to the liquid jetting head.

12. The liquid jetting apparatus according to claim 1, wherein the first supply channels are formed of: a first common supply channel connected to the first tank; and first individual supply channels connecting the first common supply channel and the liquid jetting heads, the second supply channels are formed of: a second common supply channel connected to the second tank; and second individual supply channels connecting the second common supply channel and the liquid jetting heads, the first common supply channel is connected to the first tank at only one end in a longitudinal direction thereof, and the second common supply channel is connected to the second tank at only one end in a longitudinal direction thereof.

13. The liquid jetting apparatus according to claim 1, wherein the first return channels are formed of: a first common return channel connected to the first tank; and first individual return channels connecting the first common return channel and the liquid jetting heads, the second return channels are formed of: a second common return channel connected to the second tank; and second individual return channels connecting the second common return channel and the liquid jetting heads, the first common return channel is connected to the first tank at only one end in a longitudinal direction thereof, and the second common return channel is connected to the second tank at only one end in a longitudinal direction thereof.

* * * * *